US005465136A

United States Patent [19]

Watanabe

[11] Patent Number: 5,465,136

[45] Date of Patent: Nov. 7, 1995

[54] IMAGE FORMING APPARATUS AND PROCESS CARTRIDGE DETACHABLE THERETO WITH CHARGING MEMBER PRESSURE CONTACT RELEASE FEATURE

[75] Inventor: Kazushi Watanabe, Yokohama, Japan

[73] Assignee: Canon Kabushiki Kaisha, Tokyo, Japan

[21] Appl. No.: 215,734

[22] Filed: Mar. 22, 1994

[30] Foreign Application Priority Data

Mar. 23, 1993 [JP] Japan ..... 5-088049

[51] Int. Cl.[6] ..... G03G 15/00; G03G 21/18

[52] U.S. Cl. ..... 355/210; 355/219

[58] Field of Search ..... 355/208, 210, 355/219

[56] References Cited

U.S. PATENT DOCUMENTS 5,095,335 3/1992 Watanabe et al. ..... 355/210

5,223,893 6/1993 Ikemoto et al. ..... 355/200

FOREIGN PATENT DOCUMENTS 63-149669 6/1988 Japan .

5-323694 12/1993 Japan ..... 355/210

*Primary Examiner*—Joan H. Pendegrass

*Attorney, Agent, or Firm*—Fitzpatrick, Cella, Harper & Scinto

[57] ABSTRACT

In a process cartridge detachable from an image forming apparatus, presssure contact between a charging member, and an image bearing member for bearing an image can be released. Hence, it is possible to prevent the occurrence of traces caused by pressure, creep, and contamination in the image bearing member and the charging member. In addition, by arranging so that the process cartridge cannot be mounted in the image forming apparatus in a state in which the pressure contact between the charging member and the image bearing member is released, failure in charging on the image bearing member by the charging member can be prevented.

20 Claims, 24 Drawing Sheets

IMAGE FORMING APPARATUS AND PROCESS CARTRIDGE DETACHABLE THERETO WITH CHARGING MEMBER PRESSURE CONTACT RELEASE FEATURE

BACKGROUND OF THE INVENTION

1. Field of the Invention

This invention relates to an image forming apparatus, such as a laser-beam printer or a copier, including an image bearing member, such as a photosensitive member or a dielectric member, and a charging member for charging the image bearing member, and to a process cartridge which is detachable with respect to the image forming apparatus.

2. Description of the Related Art

In many image forming apparatuses, such as copiers or the like, process units, such as an image bearing member (a photosensitive drum), a cleaning unit, a developing unit and the like, are accommodated within a cartridge, so that they are detachable with respect to the main body of the apparatus as one body in the form of a process cartridge. In such an image forming apparatus, when any of the process units within the cartridge has come to an end of its life, or any consumable material (for example, toner within the developing unit) has been used up, the entire process cartridge is exchanged for ease of maintenance.

Chargers, such as a primary charger, a transfer charger, and the like, are disposed around the photosensitive drum so as to supply various kinds of electric charges to the photosensitive drum. A noncontact-type corona charger utilizing corona discharge, a charging roller used in contact with the photosensitive drum in the form of a roller, or the like may be used as such a charger.

If a corona charger is used as the primary charger, noxious ozone is generated during corona discharge. Accordingly, an ozone filter is required within the image forming apparatus, thereby causing an increase in production costs and also an increase in the size of the image forming apparatus.

If a contact-type charger in pressure contact with the photosensitive drum, such as a charging roller, is used as a primary charger instead of the corona charger, the generation of ozone is pevented.

However, in conventional image forming apparatuses, if there is an extended time period until the process cartridge is used after it has been manufactured, or if there is an extended time period until the process cartridge is recycled after it has been used, the charging roller stays in pressure contact with the photosensitived drum at the same portion. Hence, for example, traces caused by pressure may be produced in the charging roller and the photosensitive drum, contact portions of the charging roller and the photosensitive drum may be permanently deformed due to creep, or the photosensitive drum may be contaminated with materials contained in the charging roller, thereby degrading the obtained image. The same problems will arise also when a charging blade is used as a contact-type charger.

In order to overcome the above-described problems, a technique is disclosed, for example, in U.S. Pat. No. 5,095,335, in which a charging roller provided in the main body of an image forming apparatus is made to be in contact with or separated from a photosensitive drum provided in a process cartridge linked with mounting and detaching of the process cartridge. However, since a charging roller is not provided in the process cartridge, the mechanism of mounting and detaching the process cartridge to the image forming apparatus becomes complicated.

SUMMARY OF THE INVENTION

It is an object of the present invention to provide an image forming apparatus and a process cartridge, in which, even if an image bearing member and a charging member in contact therewith are used, traces caused by pressure, creep and contamination are not produced in the image bearing member and the charging member.

It is another object of the present invention to provide an image forming apparatus and a process cartridge, in which an image bearing member and a charging member are provided in the process cartridge, so that the mechanism of mounting/detaching the process cartridge with respect to the image forming apparatus is simplified.

It is still another object of the present invention to provide an image forming apparatus and a process cartridge, in which pressure contact between an image bearing member and a charging member can be released in a state of detaching the process cartridge from the image forming apparatus.

A process cartridge detachably mountable in an image forming apparatus, the process cartridge comprising an image bearing member for bearing an image, and a charging member, which is movable to be in releasable pressure contact with the image bearing member, for charging the image bearing member, wherein mounting of the process cartridge to the image forming apparatus is prohibited when pressure contact between the image bearing member and the charging member is released.

An image forming apparatus, including a process cartridge detachably mountable in the image forming apparatus, the process cartridge cartridge comprising an image bearing member for bearing an image, and a charging member in releasable pressure contact with the image bearing member, for charging the image bearing member, and release means for releasing the pressure contact between the image bearing member and the charging member, wherein the mounting of the process cartridge in the apparatus is prohibited when the pressure contact between the image bearing member and the charging member is released.

The foregoing and other objects, advantages and features of the present invention will become more apparent from the following detailed description taken in conjuction with the accompanying drawings.

DETAILED DESCRIPTION OF THE PREFERRED EMBODIMENTS

First Embodiment

Figure 1:
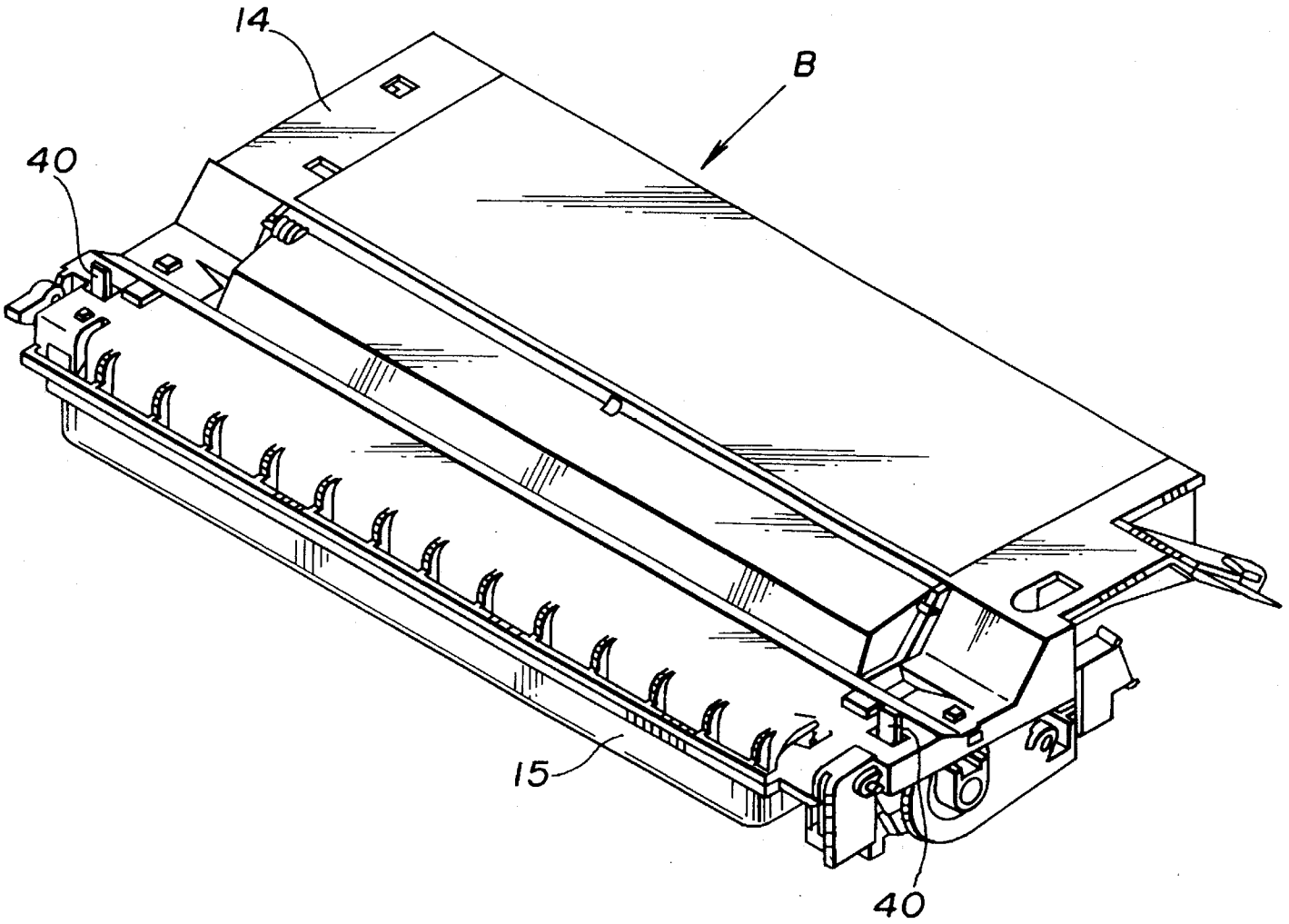
FIG. 1 is a pespective view illustrating an external appearance of a process cartridge according to any of first through fifth embodiments of the present invention.
Figure 2:
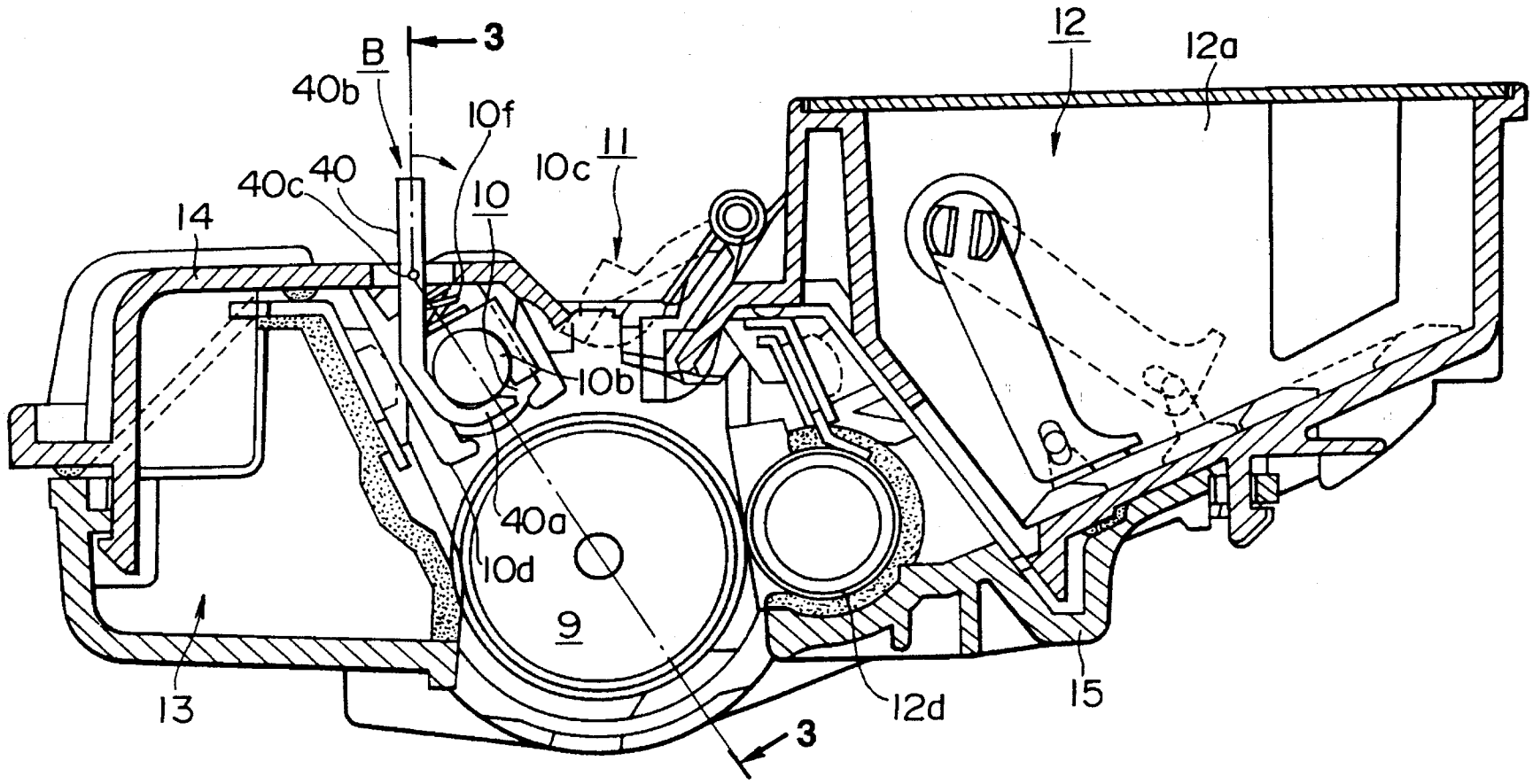
FIG. 2 is a vertical, cross-sectional view of a process cartridge according to a first embodiment of the present invention.
Figure 3:
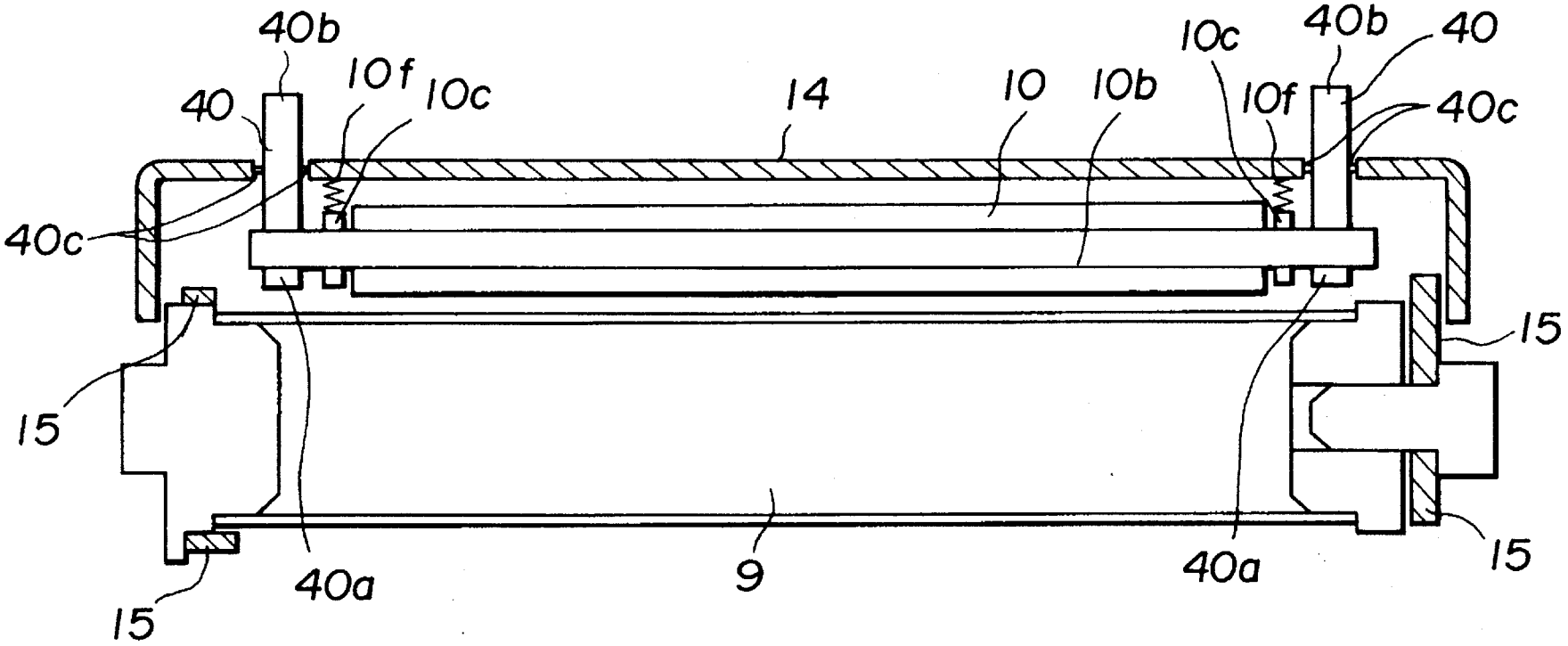
FIG. 3 is a cross-sectional view taken along line 3—3 of the process cartridge shown in FIG. 2.

A first embodiment of the present invention will now be described with reference to the drawings. FIG. 1 is a perspective view of a process cartridge to which the present invention is applied. FIG. 2 is a vertical, cross-sectional view of the process cartridge shown in FIG. 1. FIG. 3 is a cross-sectional view taken along line 3—3 of the process cartridge shown in FIG. 2.

The process cartridge B includes at least an image bearing member and charging means, serving as process means. The process means includes, for example, charging means for charging the surface of the image bearing member, developing means for forming a toner image on the image bearing member, cleaning means for removing toner particles remaining on the surface of the image bearing member, and the like. As shown in FIGS. 2 and 3, the process cartridge B of the present embodiment disposes charging roller 10, serving as a contact charging member, developing means 12 accommodating a toner (developer), and cleaning means 13 around electrophotographic photosensitive drum 9, serving as an image bearing member. These components are covered with a housing, comprising upper and lower frames 14 and 15, so that they are provided as one body in the form of a cartridge detachable with respect to frame 16 of the main body of the image forming apparatus (see FIG. 9).

Charging roller 10, exposure means 11, and toner reservoir **12*a* for developing means 12 are provided in upper frame 14. Photosensitive drum 9, developing roller 12*d* for developing means 12, and cleaning means 13 are provided in lower frame 15**.

The charging means is used for charging the surface of the photosensitive drum 9. In the present embodiment, a so-called contact charging method, as described in Japanese Patent Laid-open Application (Kokai) No. 63-149669 (1988), is used for the charging means. That is, as shown in FIG. 2, charging roller 10, to which a voltage is applied from a power supply, is provided so as to be rotatable by sliding bearings **10*c* within upper frame 14. The charging roller 10 comprises, for example, a metallic roller shaft 10*b* (for example, a conductive core made of iron, SUS (stainless steel), or the like), a layer of an elastic rubber, such as a ternary copolymer of EPDM's (ethylene propylene diene monomers), NBR (nitrile-butadiene rubber), or the like, provided thereon, and a layer of urethane rubber, in which carbon is dispersed, provided around the circumferential surface of the above-described layer, or comprises a metallic roller shaft coated with a layer of foamed urethane rubber in which carbon is dispersed. The roller shaft 10*b* of the charging roller 10 is mounted so as not be detached by bearing slide guide pawl 10*d* of upper frame 14 via sliding bearings 10*c* in a state in which it is slightly slidable in the directions of approaching and separating from photosensitive drum 9. Springs 10*f* are provided between sliding bearings 10*c* for supporting roller shaft 10*b*, and upper frame 14 drive roller shaft 10*b* in the direction of photosensitive drum 9, so that charging roller 10 is in pressure contact with the surface of photosensitive drum 9**.

The process cartridge B further includes pressure-releasing pieces 40 for separating charging roller 10 from photosensitive drum 9. As shown in FIG. 3, pressure-releasing pieces 40 are supported on upper frame 14 so as to be rotatable around fulcrums **40*c* provided in upper frame 14 in the vicinity of both ends of charging roller 10 in the longitudinal direction. As shown in FIG. 2, pressure-releasing pieces 40 raise charging-roller shaft 10*b* by their distal-end portions 40*a*, serving as pressure-releasing portions, so that charging roller 10 does not contact photosensitive drum 9**.

Figure 4:
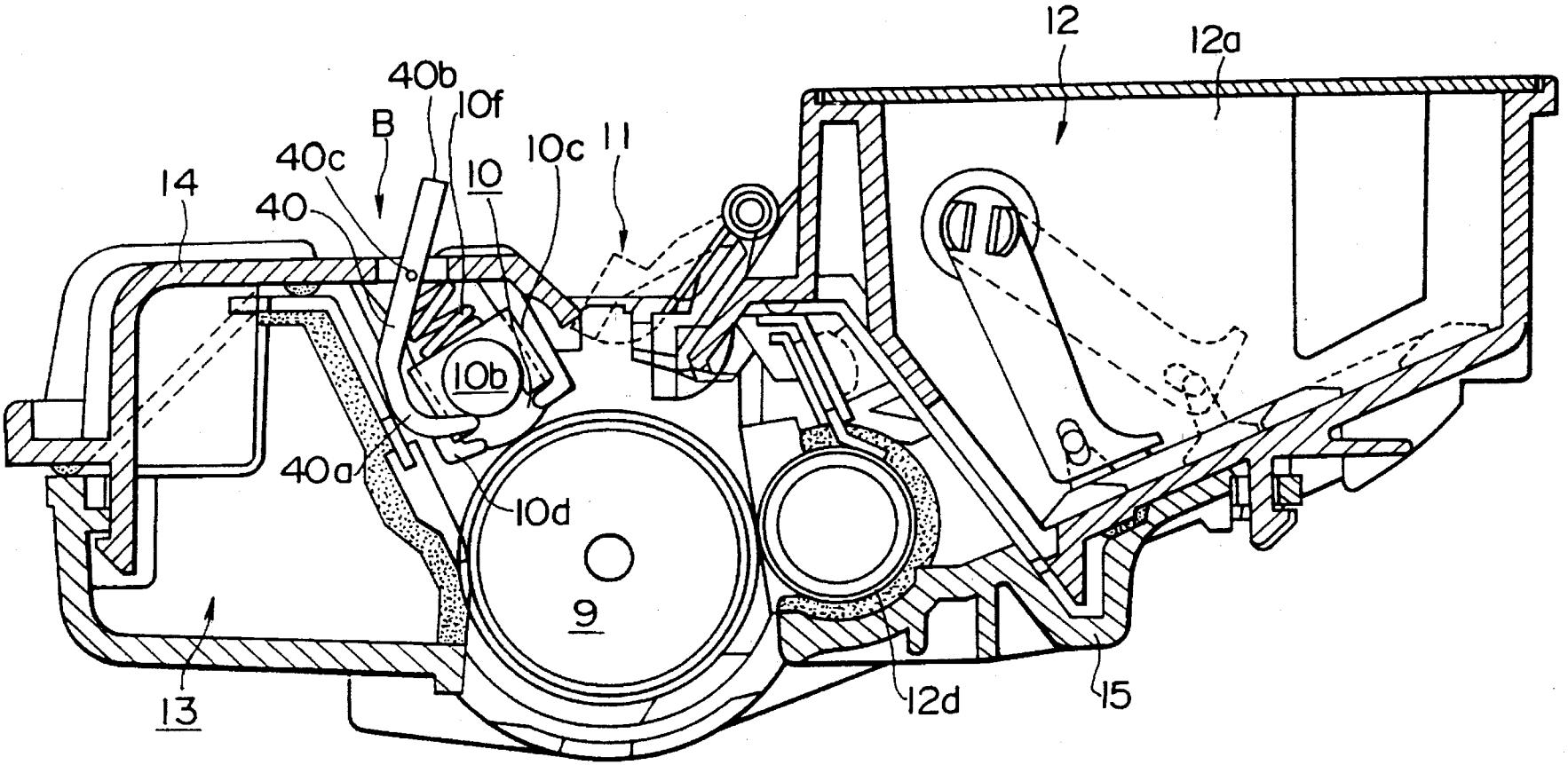
FIG. 4 is a vertical, cross-sectional view illustrating the function of the image forming apparatus shown in FIG. 1.

When the operator intends to use the process cartridge B, he rotates pressure-releasing pieces 40 in the direction of arrow D, as seen in FIG. 2, by holding respective gripping members **40*b* of pressure-releasing pieces 40. Thus, distal-end portions 40*a* of pressure-releasing pieces 40 are detached from shaft 10*b* of charging roller 10, and sliding bearings 10*c* move along bearing slide guide pawl 10*d* by the force of springs 10*f*, whereby charging roller 10 also moves. Hence, charging roller 10 becomes in pressure contact with photosensitive drum 9 (see FIG. 4). Thereafter, as shown in FIGS. 8 and 9**, the process cartridge B is mounted in the main body of the image forming apparatus.

When the cartridge B has been mounted in the main body of the apparatus, a state, in which a power supply provided in the main body of the image forming apparatus can apply a voltage to the charging member, is provided.

Figure 9:
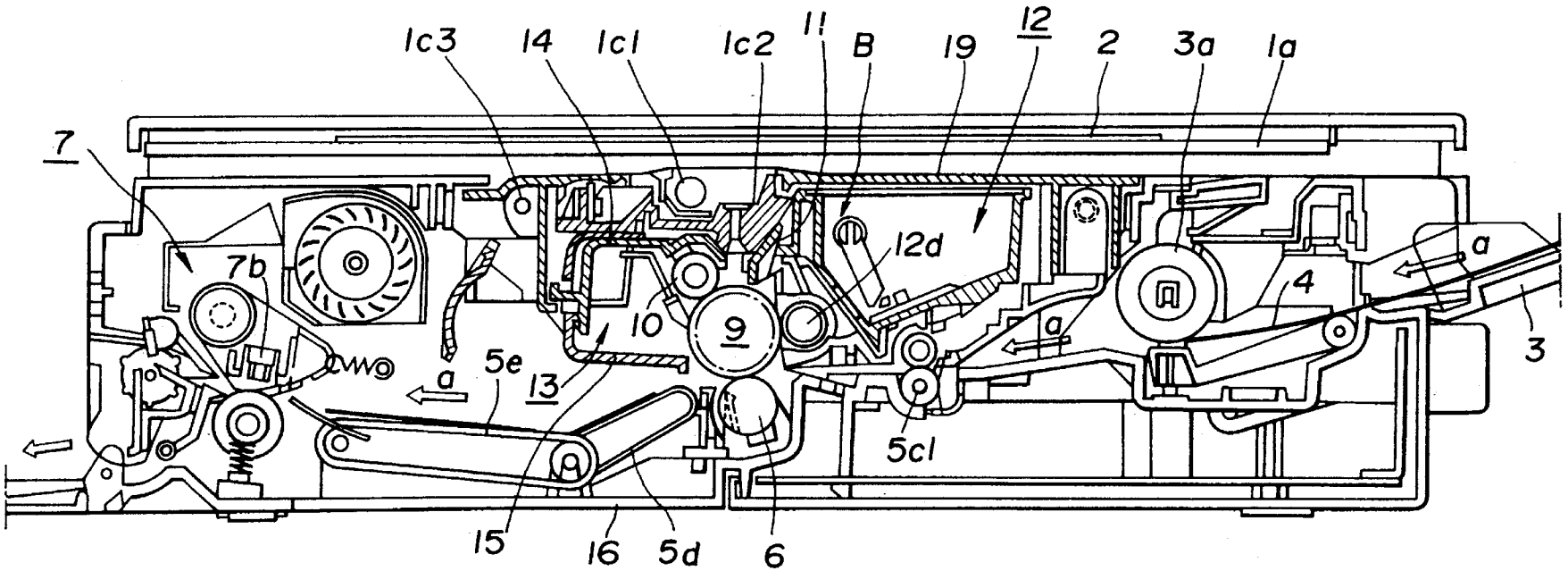
FIG. 9 is a vertical, cross-sectional view illustrating a state after the process cartridge has been mounted on the main body of the image forming apparatus.

In FIG. 9, original-mount glass la is movable in the vertical direction as viewed in FIG. 9, and is connected to a driving device so as to perform reciprocating movement. Original 2 on original-mount glass 1*a* is illuminated by illuminating lamp 1c1 during the forward or backward movement of original-mount glass 1*a*. Light reflected by original 2 is imaged onto photosensitive drum 9, which rotates in the direction of the arrow and which has been uniformly charged by charging roller 10, via short-focus lens array 1c2 to form a latent image. The latent image becomes a developed image by toner particles supplied from developing roller 12*d* of developing means 12, and the developed image moves to the position of transfer roller 6. On the other hand, a sheet of transfer material 4, fed from sheet-feeding tray 3 in the direction of arrow "a" by sheet-feeding roller 3*a*, is fed by registration roller 5c1 with a timing to coincide with the developed image, and is provided with a transfer bias potential by transfer roller 6. The developed image on photosensitive drum 9 is transferred onto the sheet of transfer material 4, which is then separated from photosensitive drum 9 and is fed to fixing device 7 by conveying devices 5*d* and 5*e*. The image is fixed on the sheet in fixing device 7, and the sheet is discharged outside the image forming apparatus.

Figure 8:
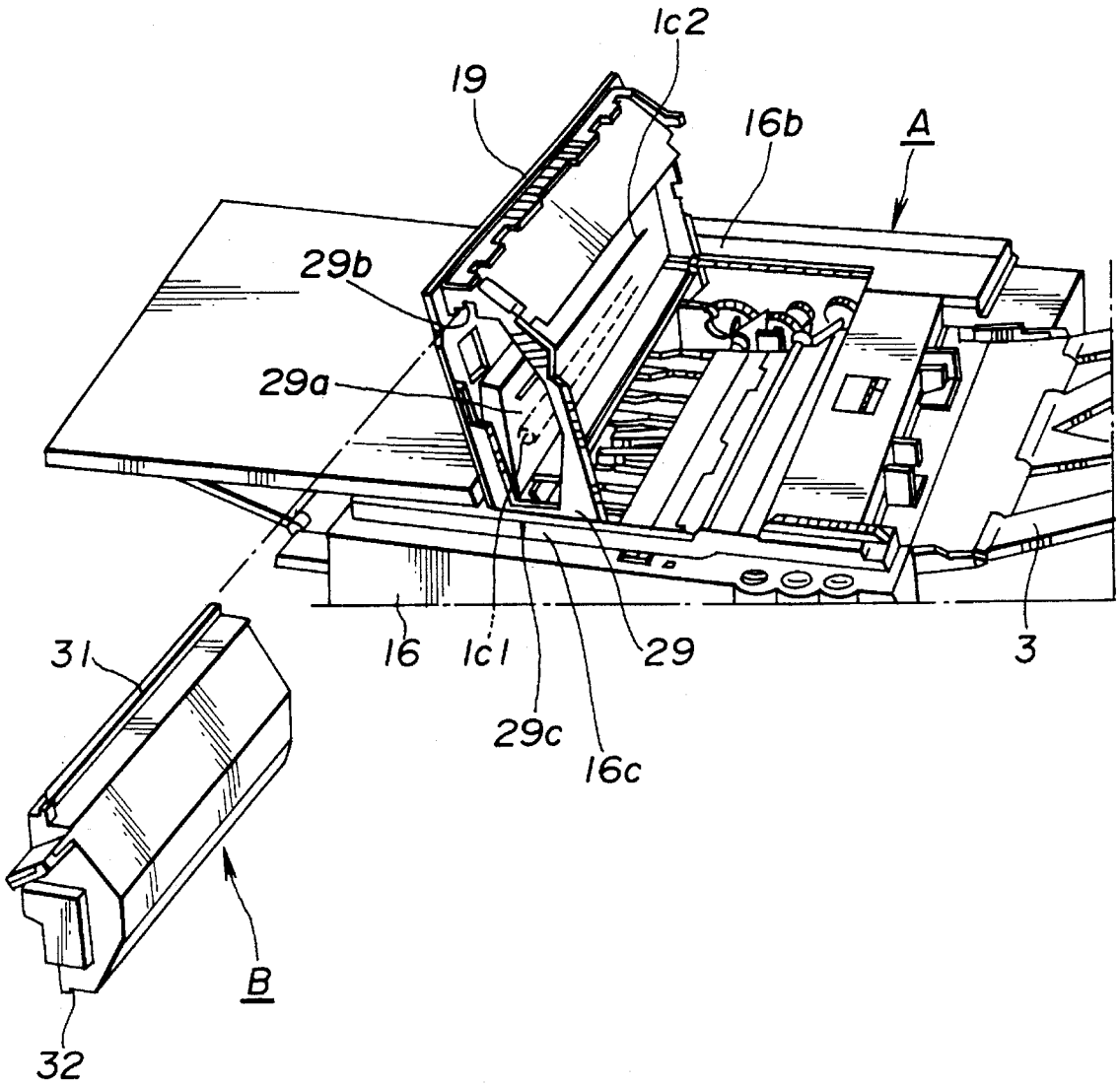
FIG. 8 is a perspective view illustrating a state when 10 the process cartridge is mounted on the upper frame of the main body of the image forming apparatus.

In the present embodiment, upper frame 19 of the main body is mounted on frame 16 of the main body of the image forming apparatus so as to be rotatable around hinge 1c3, and can take the positions shown in FIGS. 8 and 9. FIG. 8 illustrates the mounting/detaching position of process cartridge B with respect to image forming apparatus A. Guide rails 31 and 32 provided in process cartridge B slide into guide grooves 29*b* and 29*c*, parallel to photosensitive drum 9, provided in upper frame 19 of the main body, whereby process cartridge B is mounted in upper frame 19 of the main body. Process cartridge B is accommodated within main body 16 of the apparatus by rotating upper frame 19 around hinge 1c3.

Figure 10:
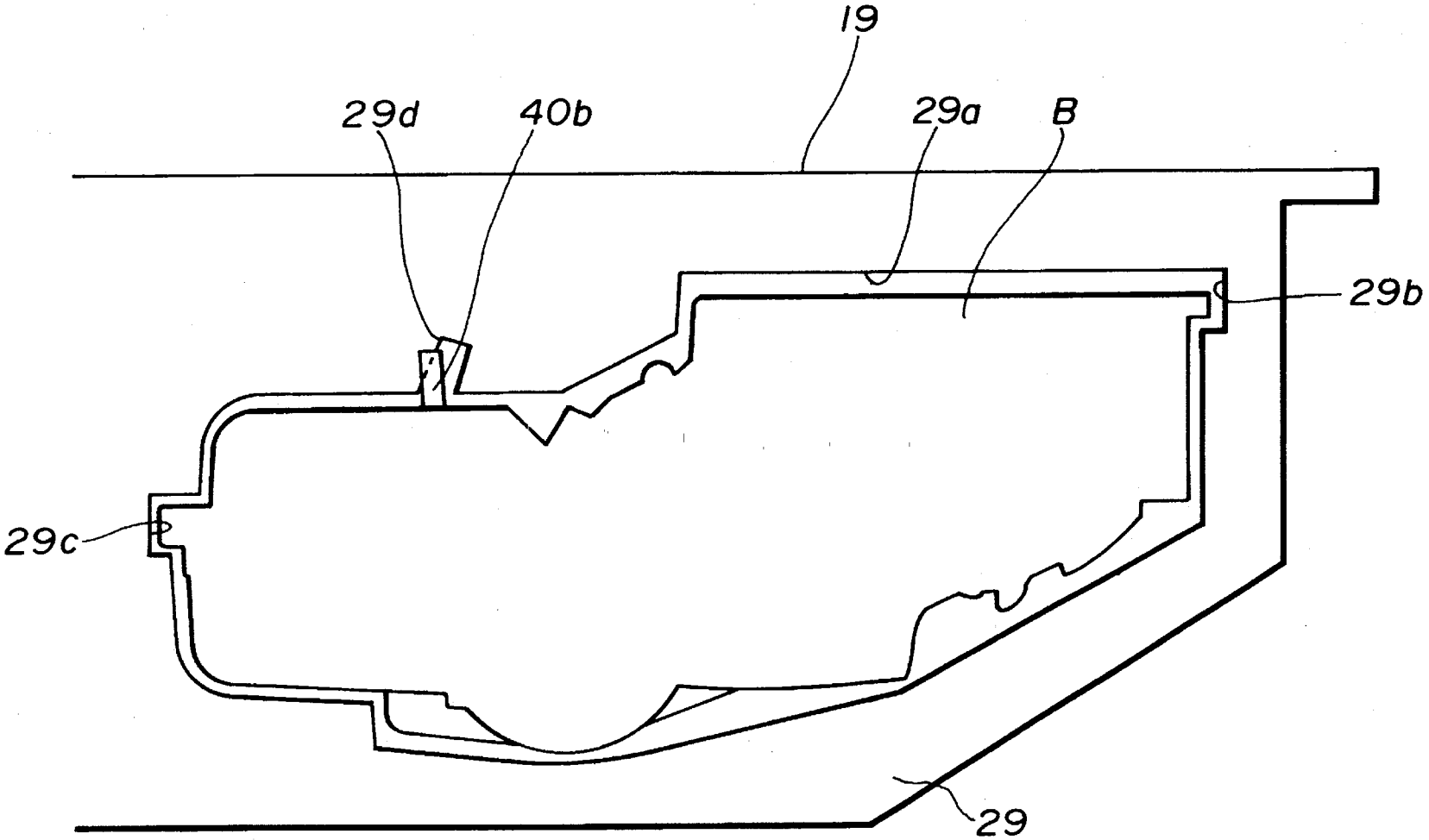
FIG. 10 is a substantially vertical, cross-sectional view illustrating the external shape of the process cartridge and a cartridge mounting portion in the upper frame of the main body of the image forming apparatus.

As shown in FIG. 10, guide grooves 29*b* and 29*c* of upper frame 19 of the main body are provided in opening 29*a*, which is substantially analogous in shape to process cartridge B and in which process cartridge B can be accommodated. Opening notches 29*d* are provided at portions of side plate 29 of upper frame 19 of the main body which forms opening 29*a*. When pressure-releasing pieces 40 are at positions of not supporting charging roller 10, i.e., when gripping members 40*b* are in an oblique state, gripping members 40*b* enter opening notches 29*d*, so that process cartridge B can be inserted into upper frame 19 of the main body from opening 29*a*. On the other hand, when charging roller 10 is supported by Pressure-releasing pieces 40 and is separated from photosensitive drum 9, i.e., when gripping members 40*b* are substantially orthogonal to the edge of opening 29*a*, gripping members 40*b* contact side plate 29 of main-body upper frame 19, so that process cartridge B cannot enter opening 29*a* of main-body upper frame 19. Thus, a foolproof mechanism is provided.

Second Embodiment

Figure 5:
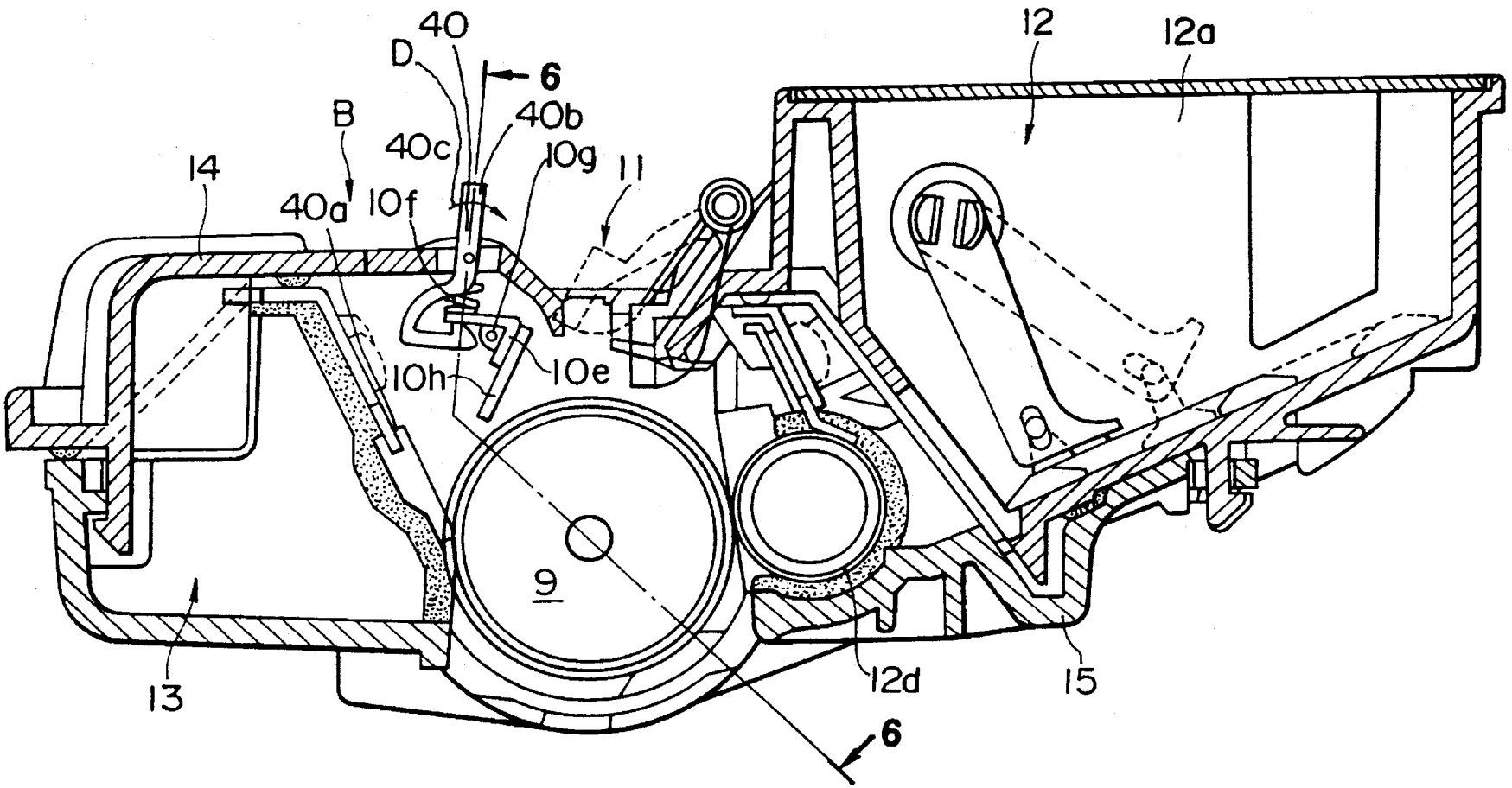
FIG. 5 is a vertical, cross-sectional view of a process cartridge according to a second embodiment of the present invention.
Figure 6:
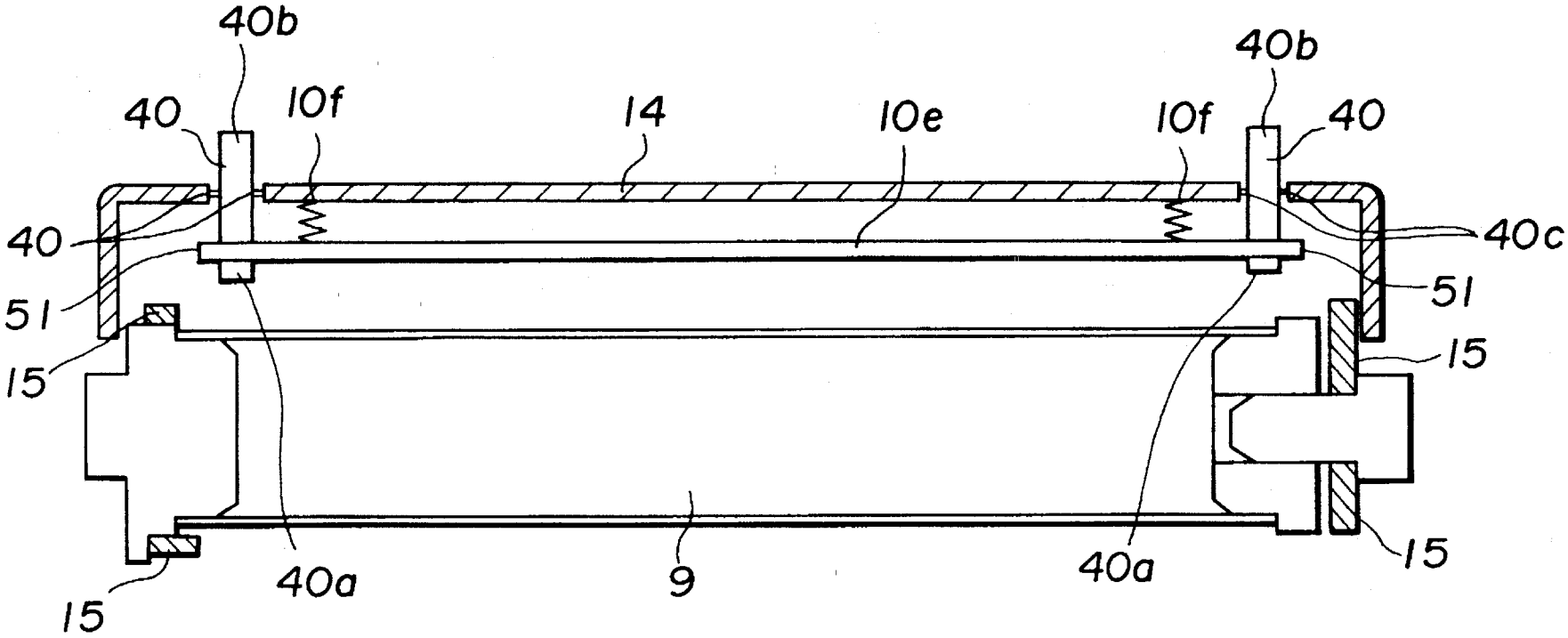
FIG. 6 is a cross-sectional view taken along line 6—6 of the process cartridge shown in FIG. 5.
Figure 7:
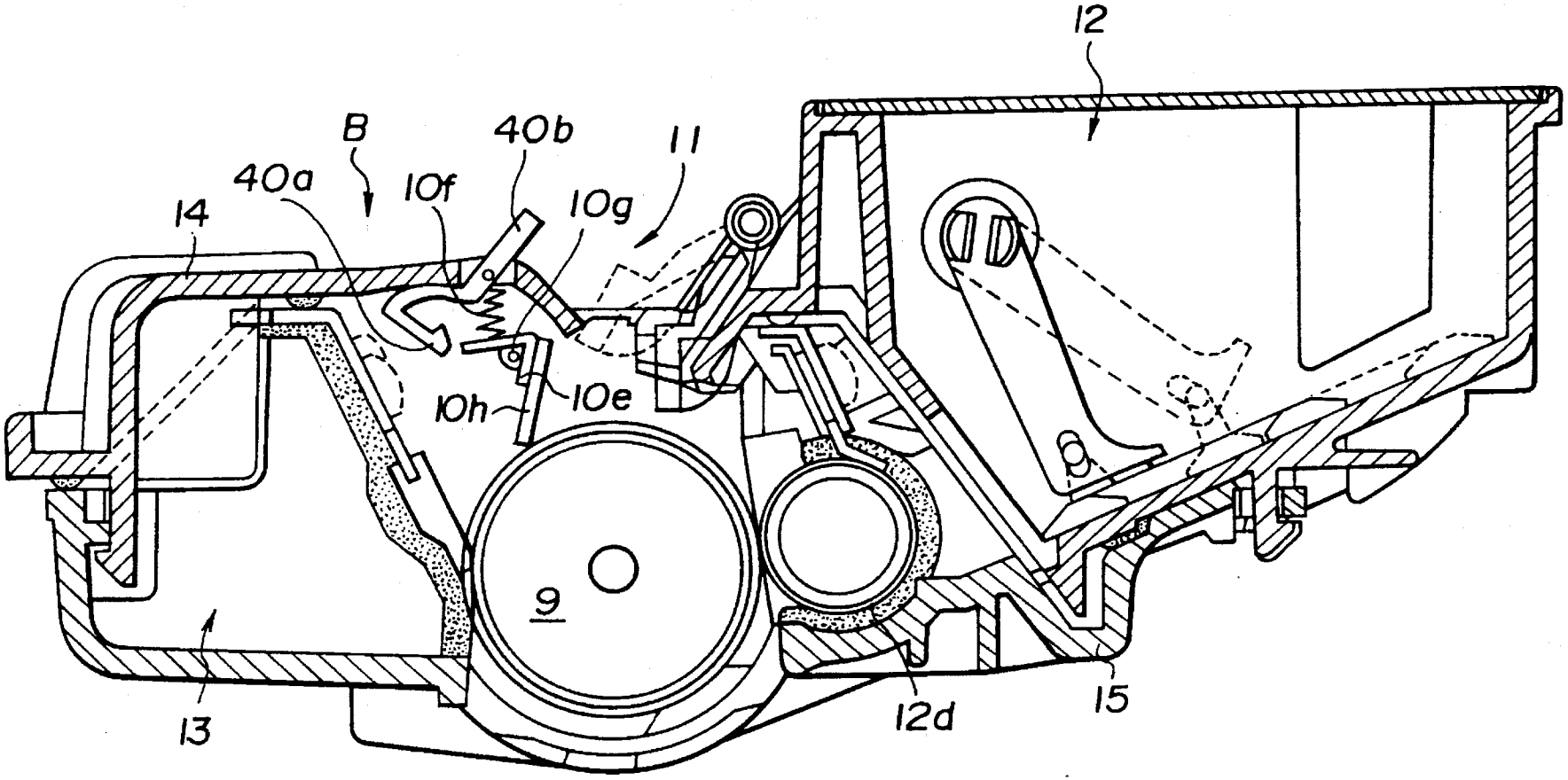
FIG. 7 is a vertical, cross-sectional view illustrating the function of the process cartridge shown in FIG. 5.

Next, a description will be provided of a second embodiment of the present invention with reference to FIGS. 5 through 7. In FIGS. 5 through 7, components having the same functions as in the first embodiment are indicated by the same reference characters, and a description thereof will be omitted.

While in the first embodiment, charging roller 10 is provided as charging means, in the present embodiment, charging blade 10*h* is provided. Charging blade 10*h* is fixed to one arm of blade holder 10*e*, having the shape of a belt crank, rotatably pivoted on upper frame 14 around shaft 10*g*. Blade holder 10*e* is rotated in a counterclockwise direction around shaft 10*g* by springs 10*f* provided between upper frame 14 and blade holder 10*e*, whereby charging blade 10*h* is driven toward photosensitive drum 9.

FIG. 6 is a cross-sectional view taken along line 6—6 shown in FIG. 5. In the present embodiment, pressure-releasing pieces 40 for separating charging blade 10*h* from photosensitive drum 9 are rotatably supported on upper frame 14 around fulcrums 40*c* provided on upper frame 14 in the vicinity of two ends 51 of blade holder 10*e* in the longitudinal direction, and rotate charging blade 10*h* and blade holder 10*e* in a clockwise direction, as viewed in FIG. 7, around shaft 10*g* by raising the arm of blade holder 10*e*, to which charging blade is not fixed, by distal-end portions 40*a* of the pressure-retaining pieces 40. Thus, charging blade 10*h* does not contact photosensitive drum 9 (see FIG. 5).

When using process cartridge B, in the same manner as described in the first embodiment, in FIG. 5, pressure-releasing pieces 40 are rotated in the direction of arrow D by grasping gripping members 40*b* of pressure-releasing pieces 40 to provide a state in which charging blade 10*h* is in pressure contact with photosensitive drum 9, as shown in FIG. 7, and process cartridge B is mounted in the main body of the image forming apparatus as shown in FIGS. 8 and 9.

At that time, as shown in FIG. 10, if it is intended to mount process cartridge B in image forming apparatus A when pressure-releasing pieces 40 are in a pressure-releasing state shown in FIG. 5, gripping members 40*b* of the pieces do not coincide with notches 20*d* provided in opening 20*a* of upper frame 19 of the main body of the image forming apparatus. Hence, process cartridge B cannot be mounted.

Third Embodiment

Figure 11:
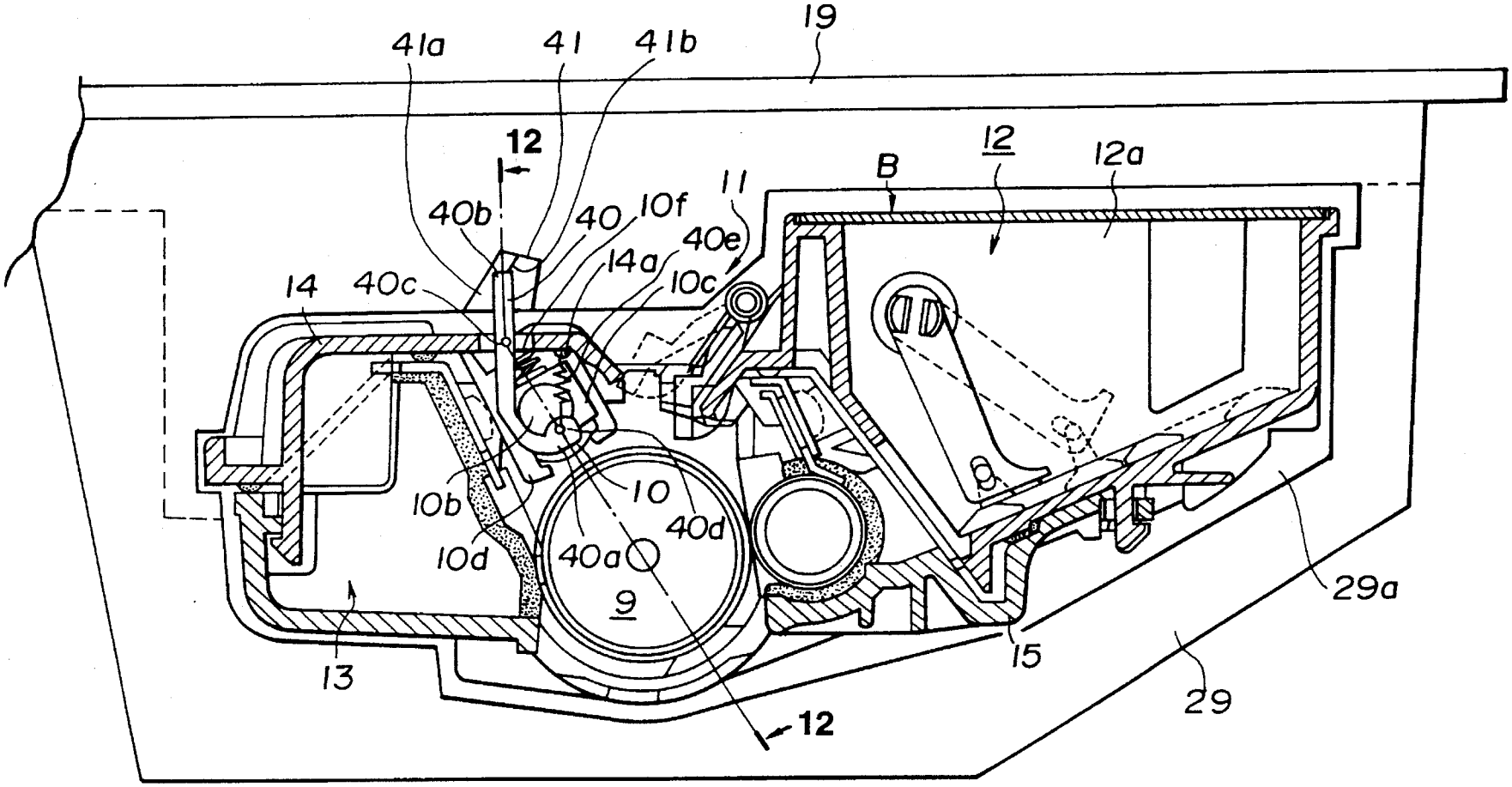
FIG. 11 is a vertical, cross-sectional view of a process cartridge according to a third embodiment of the present invention.

The external appearance of the process cartridge used in a third embodiment of the present invention is the same as in the first and second embodiments, as represented by the perspective view shown in FIG. 1. FIG. 11 is a vertical, cross-sectional view of the image forming apparatus of the third embodiment. The same components as in the first embodiment are indicated by the same reference characters, and a description thereof will be omitted. A description will be provided of only a portion around the charging roller which differs.

Figure 12:
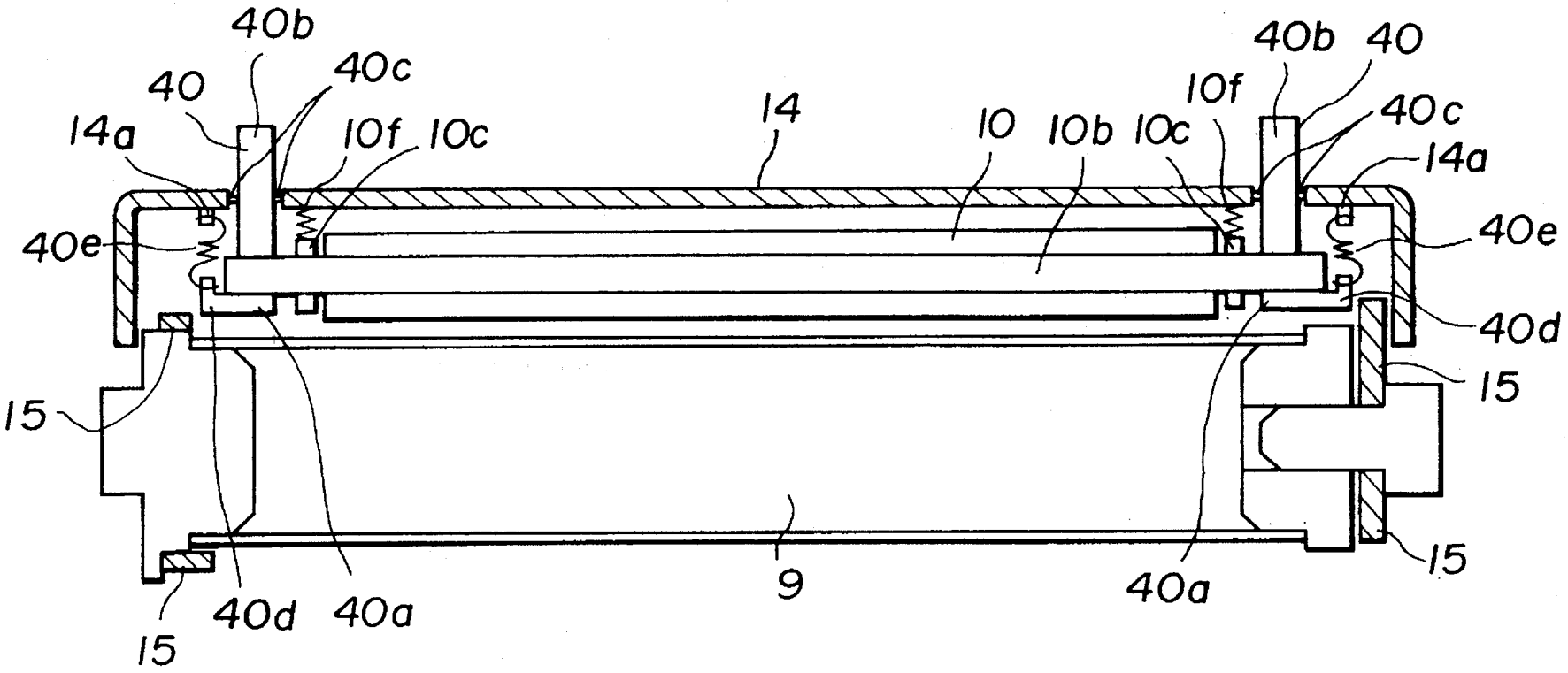
FIG. 12 is a cross-sectional view taken along line 12—12 of the process cartridge shown in FIG. 11.

Pressure-releasing pieces 40 for separating charging roller 10 from photosensitive drum 9 are provided in process cartridge B. As shown in FIG. 12, pressure-releasing pieces 40 are supported around fulcrums 40*c* provided in upper frame 14 at two ends of charging roller 10 in the longitudinal direction, and are driven in a counterclockwise direction, as viewed in FIG. 11, around fulcrums 40*c* by tension springs 40*e*, each provided between spring-holding bracket 14*a* of upper frame 14 and spring holder 40*d* provided at distal-end portion 40*a* of the piece, whereby distal-end portions 40*a* of the pieces raise shaft 10*b* of charging roller 10, so that charging roller 10 does not contact photosensitive drum 9.

The ratio of the force of compression spring 10*f* provided between bearing 10*c* and upper frame 14 as in the first embodiment to the force of the above-described tension spring 40*e* is appropriately determined. Gripping members 40*b* are not manually operated. When no force is applied to gripping members 40*b*, as shown in FIG. 11, pressure-releasing pieces 40 are rotated around fulcrums 40*c* in a counterclockwise direction by the force of tension springs 40*e* against the force of compression springs 10*f* to raise roller shaft 10*b* while grasping it by distal-end portions 40*a* of the pieces, so that charging roller 10 is separated from photosensitive drum 9.

Figure 13:
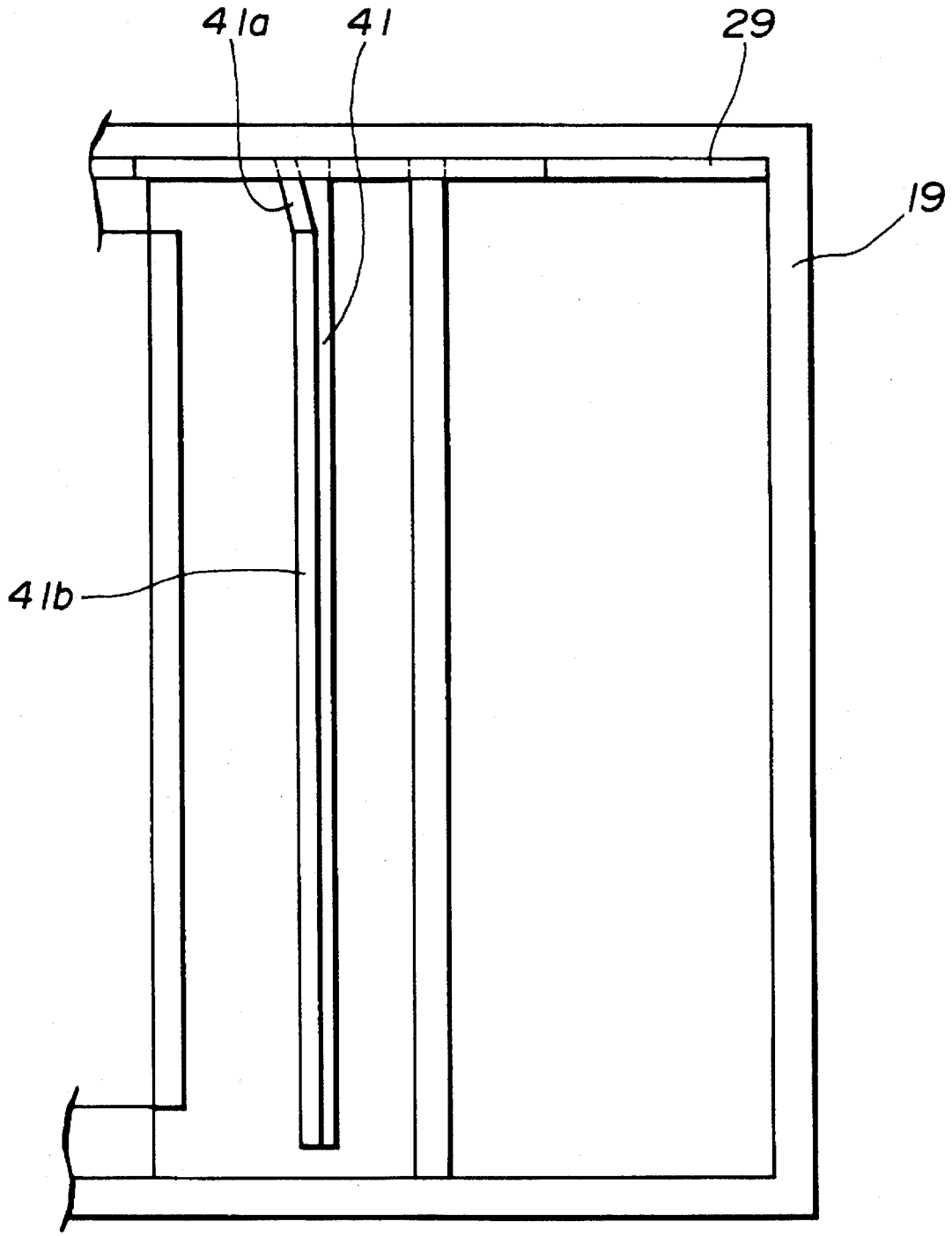
FIG. 13 is a plan view of the upper frame of the image forming apparatus, as seen from above.
Figure 14:
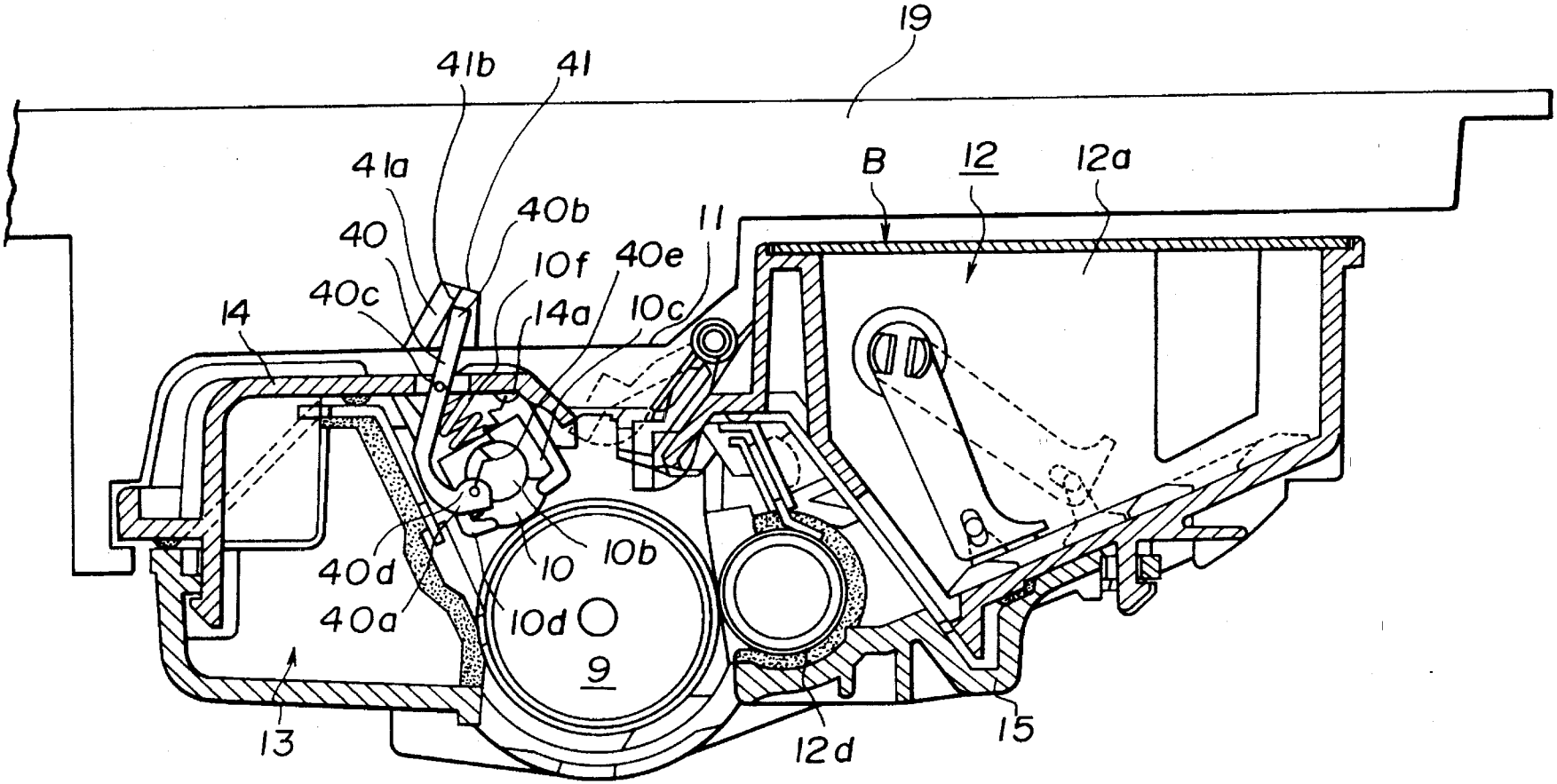
FIG. 14 is a vertical, cross-sectional view illustrating the function of the process cartridge shown in FIG. 11.

When mounting the above-described process cartridge B in main body A of the image forming apparatus, as shown in FIGS. 13 and 14, grooves 41, serving as pressure-release operation means, are provided in upper frame 19 of the main body of the apparatus. Gripping members 40*b* of pressure-releasing pieces 40 of the process cartridge contact entrance slopes 41*a* of groove 41. Thereafter, pressure-releasing pieces 40 are rotated around fulcrums 40*c* in a clockwise direction, as viewed in FIG. 11, against the force of tension springs 40*e* so as to contact pressure-releasing piece contact surfaces 41*b*. Thus, as shown in FIG. 14, distal ends 40*a* of pressure-releasing pieces 40 are disengaged from charging-roller shaft 10*b* engaged therewith, and charging roller 10 is driven toward photosensitive drum 9 by compression springs 10*f*.

When detaching process cartridge B from the main body A of the image forming apparatus, gripping members 40*b* of pressure-releasing pieces 40 are separated from contact surfaces 41*b* of grooves 41 in upper frame 19 of the main body which gripping members 40*b* have contacted. Hence, in FIG. 14, pressure-releasing pieces 40 are rotated around fulcrums 40*c* in a counterclockwise direction by tension springs 40*e*, whereby distal ends 40*a* of pressure-releasing pieces 40 engage with charging-roller shaft 10*b*, so that charging roller 10 is separated from photosensitive drum 9. If gripping members 40*b* of pressure-releasing pieces 40 do not move because of some reason when cartridge B is mounted in the main body A of the image forming apparatus, gripping members 40*b* are not guided along slopes 41a. That is, in a state in which roller 10 is separated from drum 9, gripping members 40*b* contact slopes 41a, and cartridge B cannot be mounted in main body A of the image forming apparatus.

Fourth Embodiment

Figure 15:
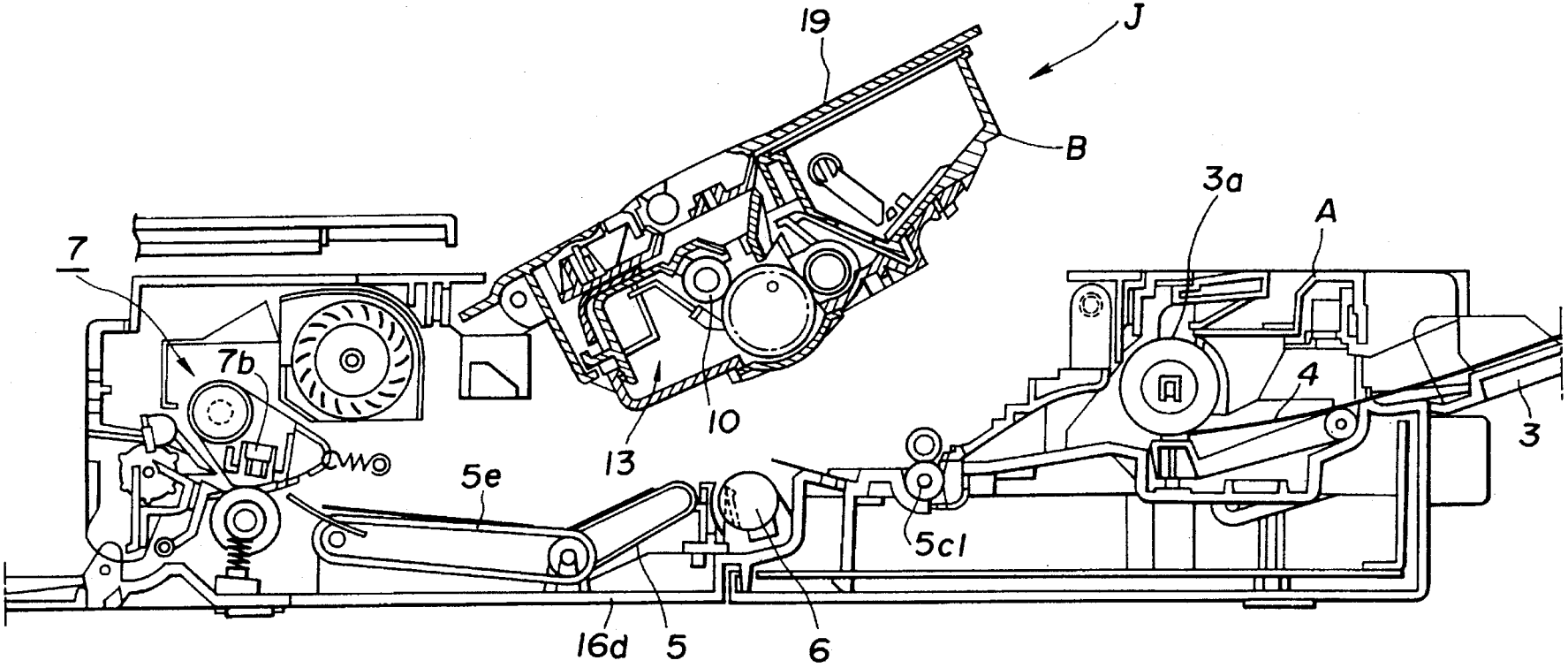
FIG. 15 is a vertical, cross-sectional view illustrating a state in which a process cartridge is mounted in the main body of an image forming apparatus according to a fourth embodiment of the present invention.
Figure 18:
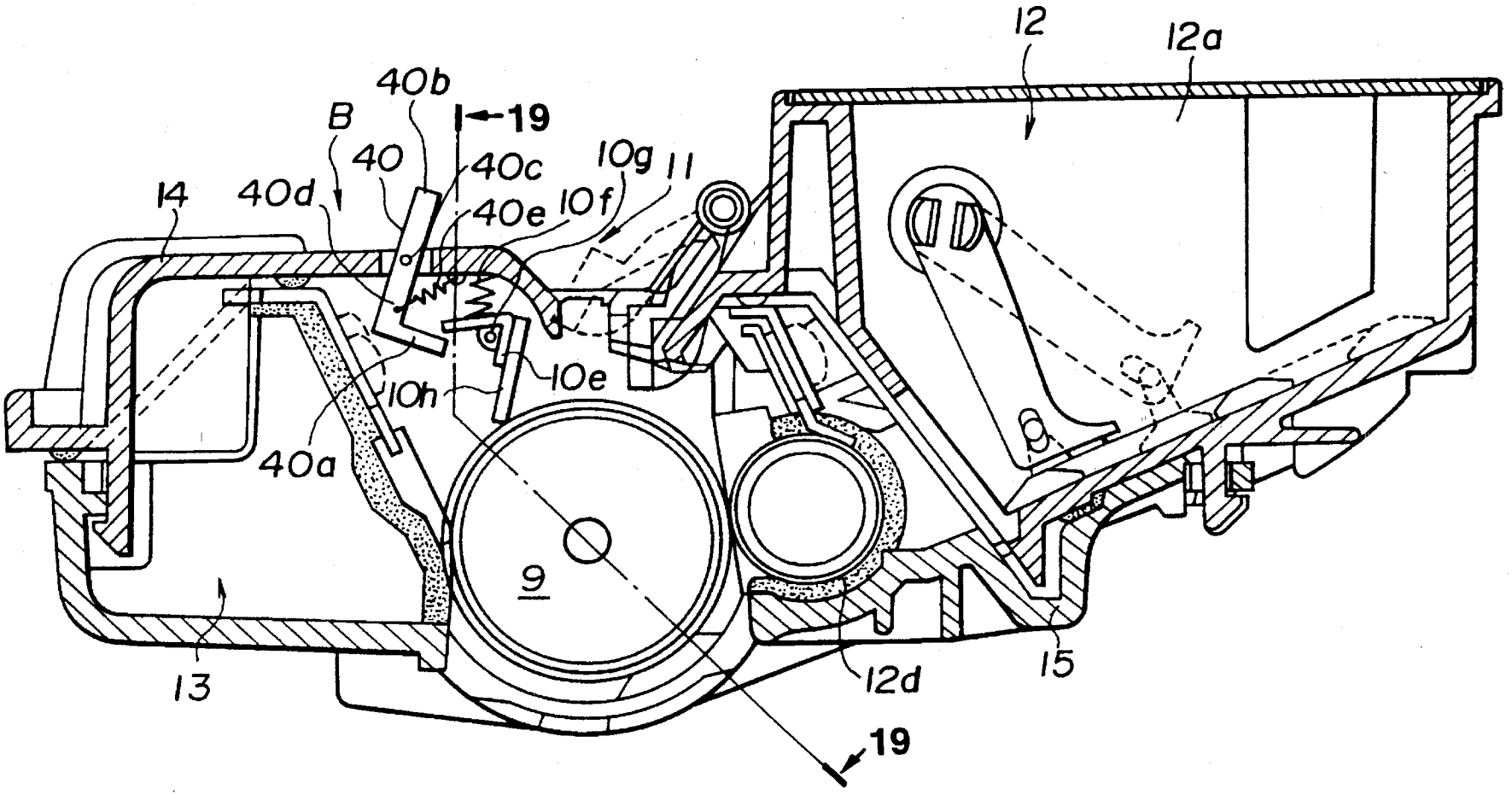
FIG. 18 is a vertical, cross-sectional view illustrating the function of the process cartridge shown in FIG. 17.

Next, a description will be provided of a fourth embodiment of the present invention with reference to FIGS. 15 and 18. In FIGS. 18 and 18, components having the same functions as in the third embodiment are indicated by the same reference characters, and a description thereof will be omitted.

In the third embodiment, a case, in which process cartridge B is detached from the main body A of the image forming apparatus from the axial direction of charging roller 10 (see FIG. 8), has been described. In the present embodiment, however, a case, in which process cartridge B is mounted from a direction orthogonal to the axis of the charging roller (the direction of arrow J in FIG. 18), will be described.

Figure 16:
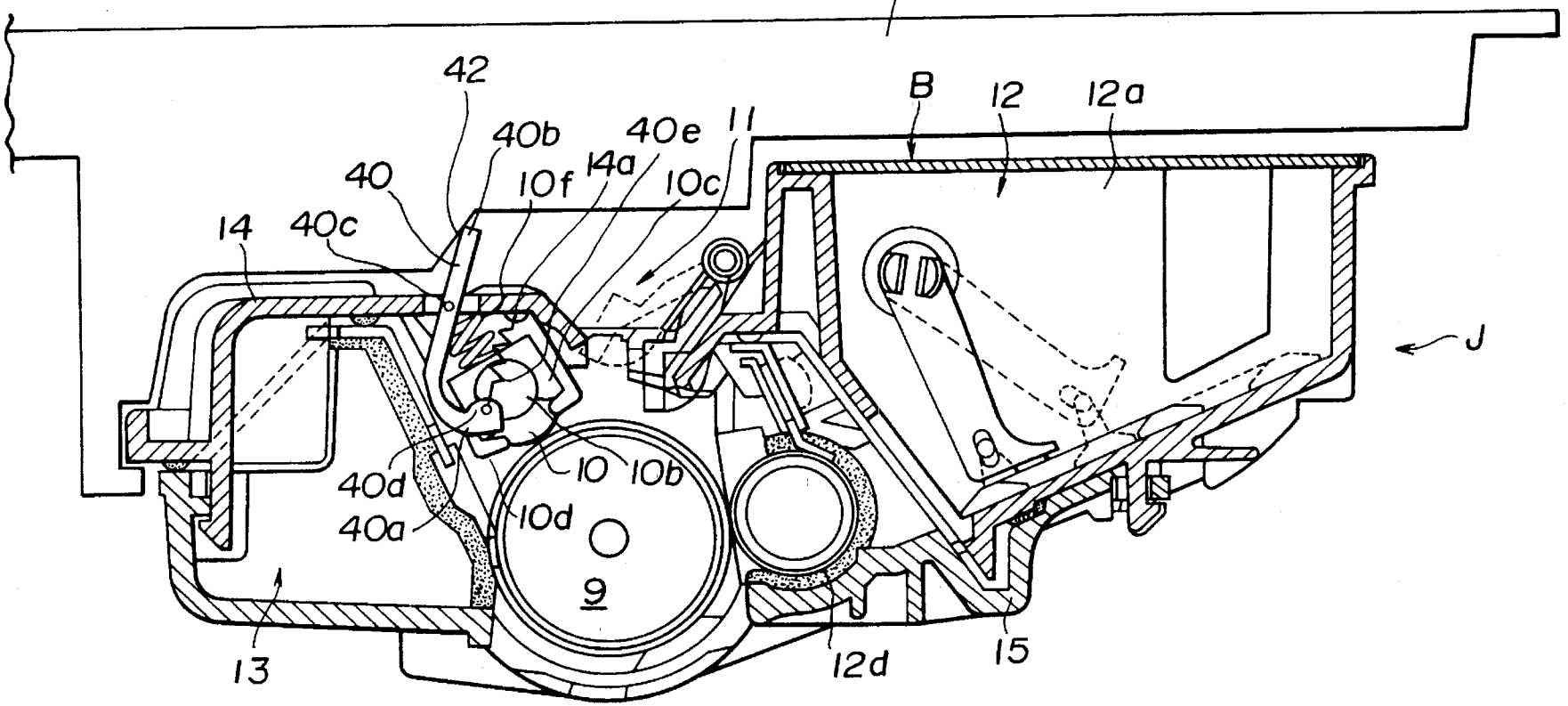
FIG. 16 is a vertical, cross-sectional view illustrating the process cartridge of the fourth embodiment.

When mounting process cartridge B in the main body A of the image forming apparatus, as shown in FIG. 15, process cartridge B is inserted from the direction of arrow J in upper frame 19 of main body A of the image forming apparatus, and is secured by securing means (not shown). At that time, as shown in FIG. 16, gripping members 40*b* of pressure-releasing pieces 40, which have separated charging roller 10 from photosensitive drum 9 by grasping roller shaft 10*b* by distal ends 40*a* of the pieces, contact contact surface 42 of upper frame 19 of the main body of the image forming apparatus provided as pressure-release operation means, and pressure-releasing pieces 40 rotate around fulcrums 40*c* in a clockwise direction, so that charging roller 10 is in pressure contact with photosensitive drum 9. On the other hand, when detaching process cartridge B from main body A of the apparatus, gripping members 40*b* of presure-releasing pieces 40 draw away contact surface 42, whereby pressure-releasing pieces 40 rotate around fulcrums 40*c* in a counterclockwise direction by the force of tension springs 40*e*, so that charging roller 10 is separated from photosensitive drum 9. If gripping members 40*b* of pressure-releasing pieces 40 do not move because of some reason when cartridge B is mounted in main body A of the image forming apparatus, i.e., in a state in which roller 10 is separated from drum 9, cartridge B cannot be mounted in main body A of the image forming apparatus.

Fifth Embodiment

Figure 17:
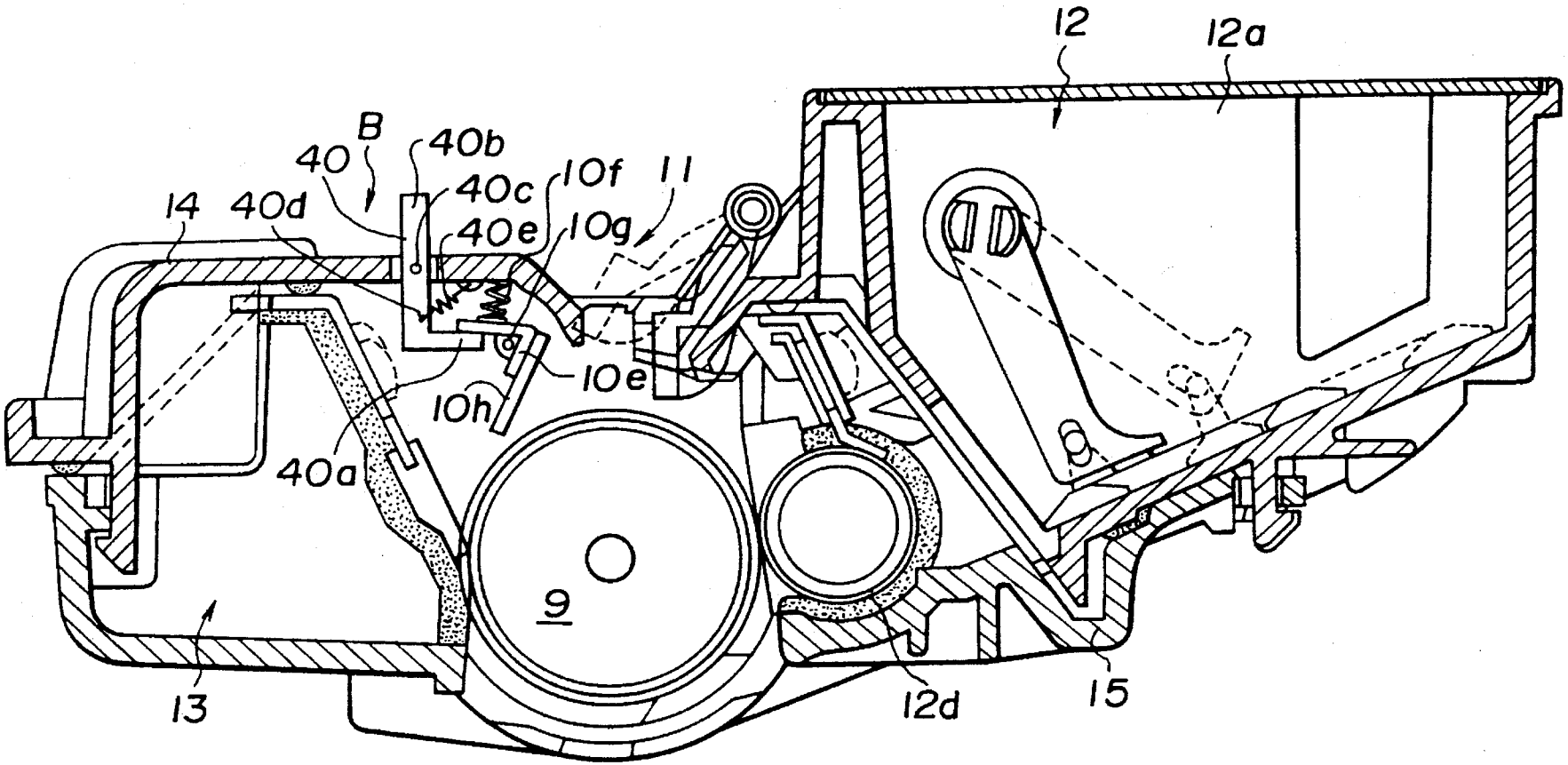
FIG. 17 is a vertical, cross-sectional view illustrating a process cartridge according to a fifth embodiment of the present invention.
Figure 19:
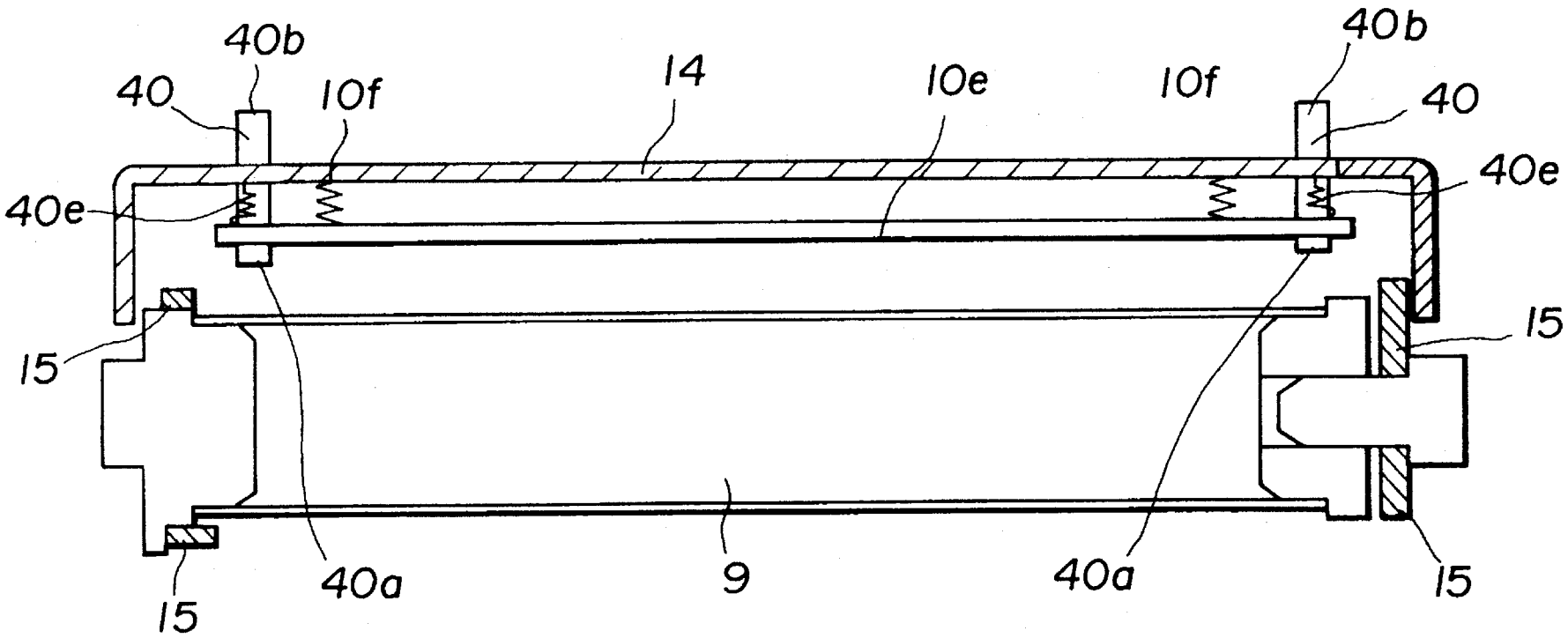
FIG. 19 is a cross-sectional view taken along line 19—19 of the image forming apparatus shown in FIG. 18.

Next, a description will be provided of a fifth embodiment of the present invention with reference to FIGS. 17 through 19. The present embodiment is substantially the same as the second embodiment. In the present embodiment, charging blade 10*h* is provided as charging means for the process cartridge. Charging blade 10*h* is fixed to blade holder 10*e* rotatably pivoted on upper frame 14 around shaft 10*g*. Blade holder 10*e* is rotated around shaft 10*g* in a counterclockwise direction by springs 10*f*, whereby blade 10*h* is driven toward photosensitive drum 9. As in the second embodiment, the process cartridge B also includes pressure-releasing pieces 40 for the charging means. When process cartridge B is detached from the main body A of the image forming apparatus, charging blade 10*h* is separated from photosensitive drum 9 by pressure-releasing pieces 40, as shown in FIG. 17. When process cartridge B is mounted in the main body A of the image forming apparatus, pressure-releasing pieces 40 do not prevent the driving of charging blade 10*h* toward photosensitive drum 9, as shown in FIG. 18. The image forming apparatus to which the present embodiment is applied includes either grooves 41 having entrance slopes 41*a* in upper frame 14 of the main body as in the third embodiment, or contact surface 42 at side plate 29 of upper frame 19 of the main body A of the image forming apparatus as in the fourth embodiment.

Sixth Embodiment

Figure 20:
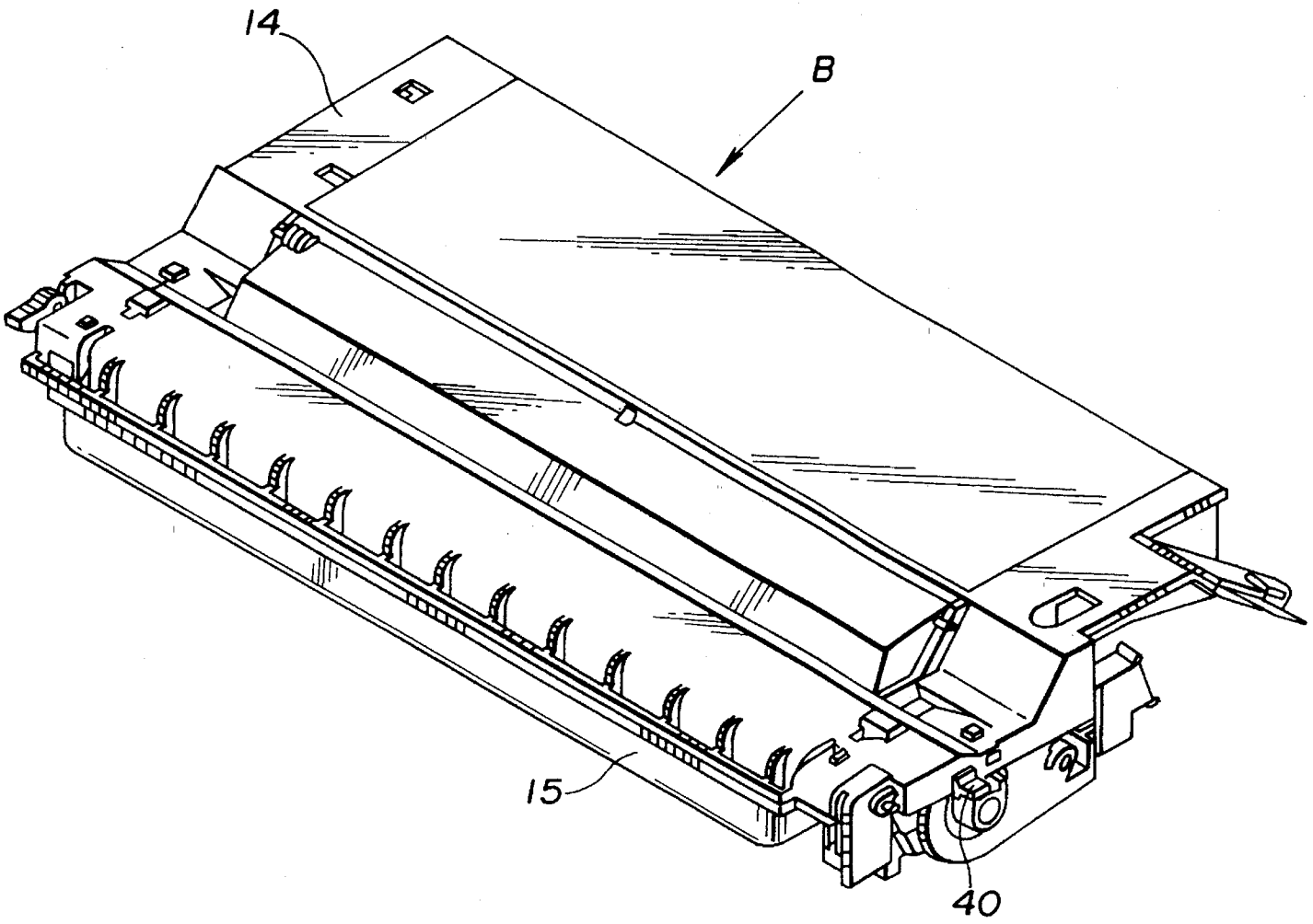
FIG. 20 is a perspective view illustrating an external appearance of a process cartridge according to sixth and seventh embodiments of the present invention.
Figure 21:
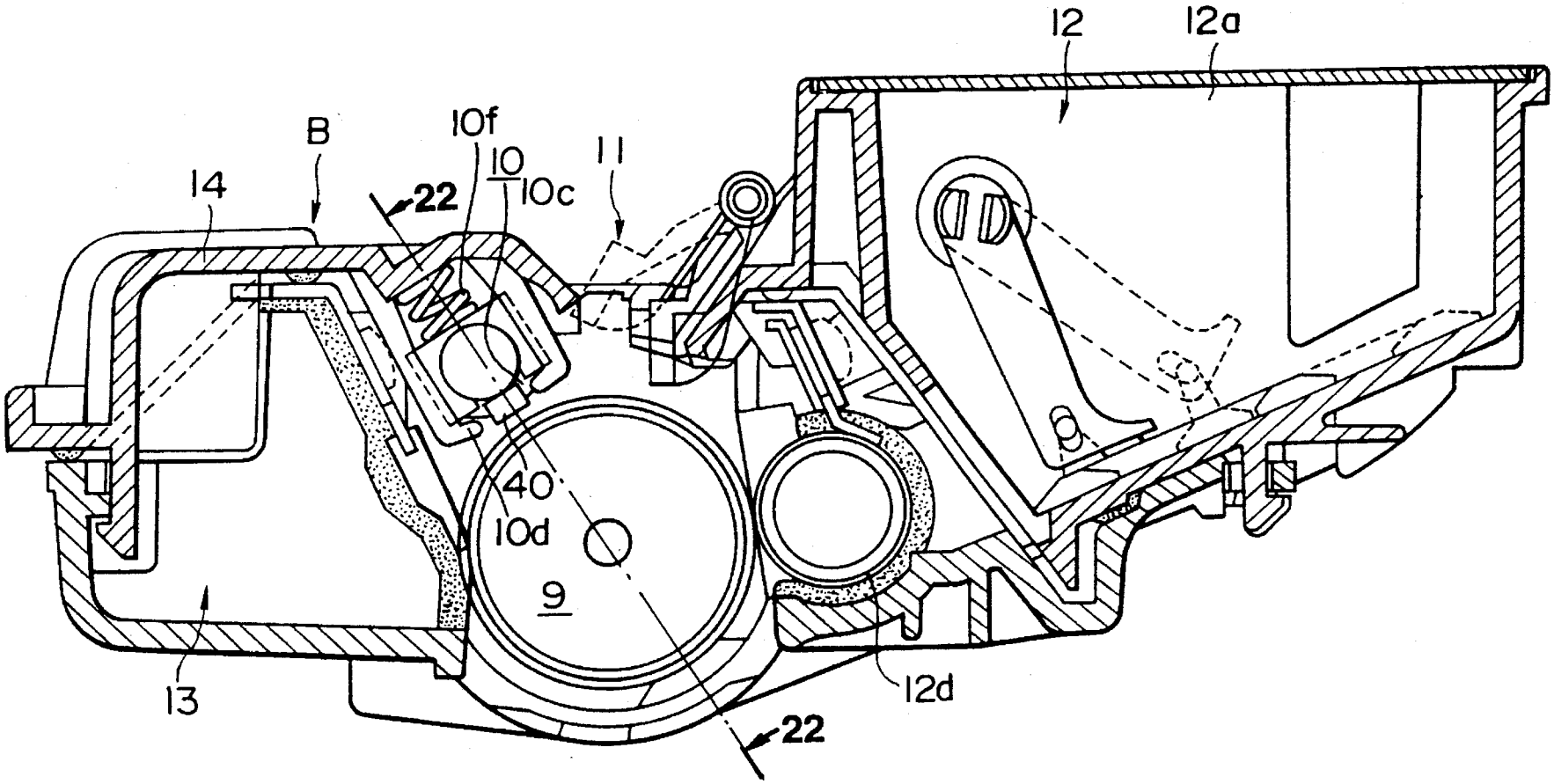
FIG. 21 is a vertical, cross-sectional view of a process cartridge according to a sixth embodiment of the present invention.
Figure 22:
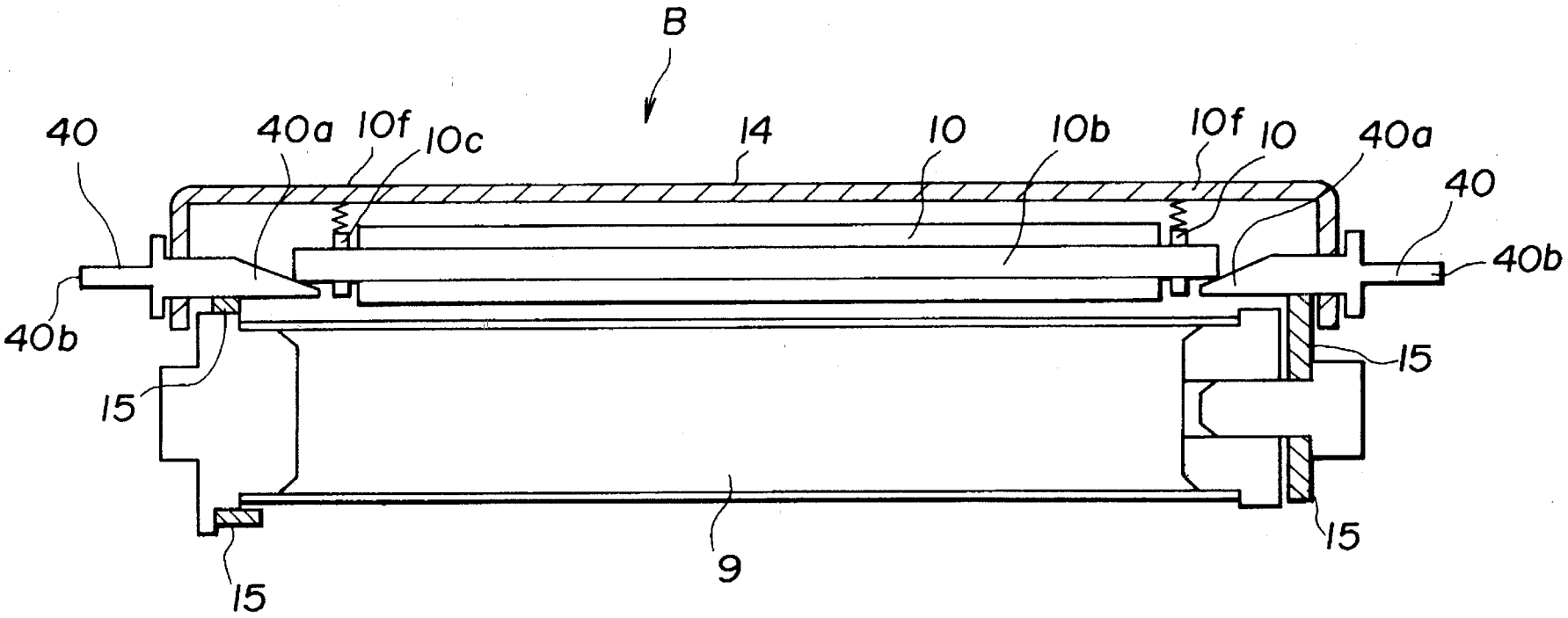
FIG. 22 is a cross-sectional view taken along line 22—22 of the process cartridge shown in FIG. 21.

FIG. 20 is a perspective view of a process cartridge according to a sixth embodiment of the present invention. FIG. 21 is a vertical, cross-sectional view of the image forming apparatus shown in FIG. 20. FIG. 22 is a cross-sectional view taken along line 22—22 shown in FIG. 21.

In FIGS. 20 through 22, the same components as in the first embodiment are indicated by the same reference characters except members for approaching/separating charging roller 10 relative to photosensitive drum 9, and a description of the same components will be omitted.

Process cartridge B includes pressure-releasing pieces 40 for separating charging roller 10 from photosensitive drum 9. As shown in FIG. 22, pressure-releasing pieces 40 are supported on upper and lower frames 14 and 15 at two ends of charging roller 10 in the longitudinal direction. Distal-end portions 40*a* of the pieces raise shaft 10*b* of charging roller 10, so that charging roller 10 does not contact photosensitive drum 9.

When using process cartridge B, pressure-releasing pieces 40 are pulled by grasping gripping members 40*b* and detached from process cartridge B, so that charging roller 10 is in pressure contact with photosensitive drum 9. Then, process cartridge B is mounted in upper frame 19 of main body A of the image forming apparatus, as shown in FIGS.

8 and 9.

At that time, if pressure-releasing pieces 40 for charging roller 10 are not detached from process cartridge B, gripping members 40*b* of pressure-releasing pieces 40 contact sides 16a and 16b of outer cover 16 of main body A of the image forming apparatus when closing upper frame 19 of the main body on main body A of the image forming apparatus, so that upper frame 19 of the main body A of the image forming apparatus cannot be completely closed.

Seventh Embodiment

Figure 23:
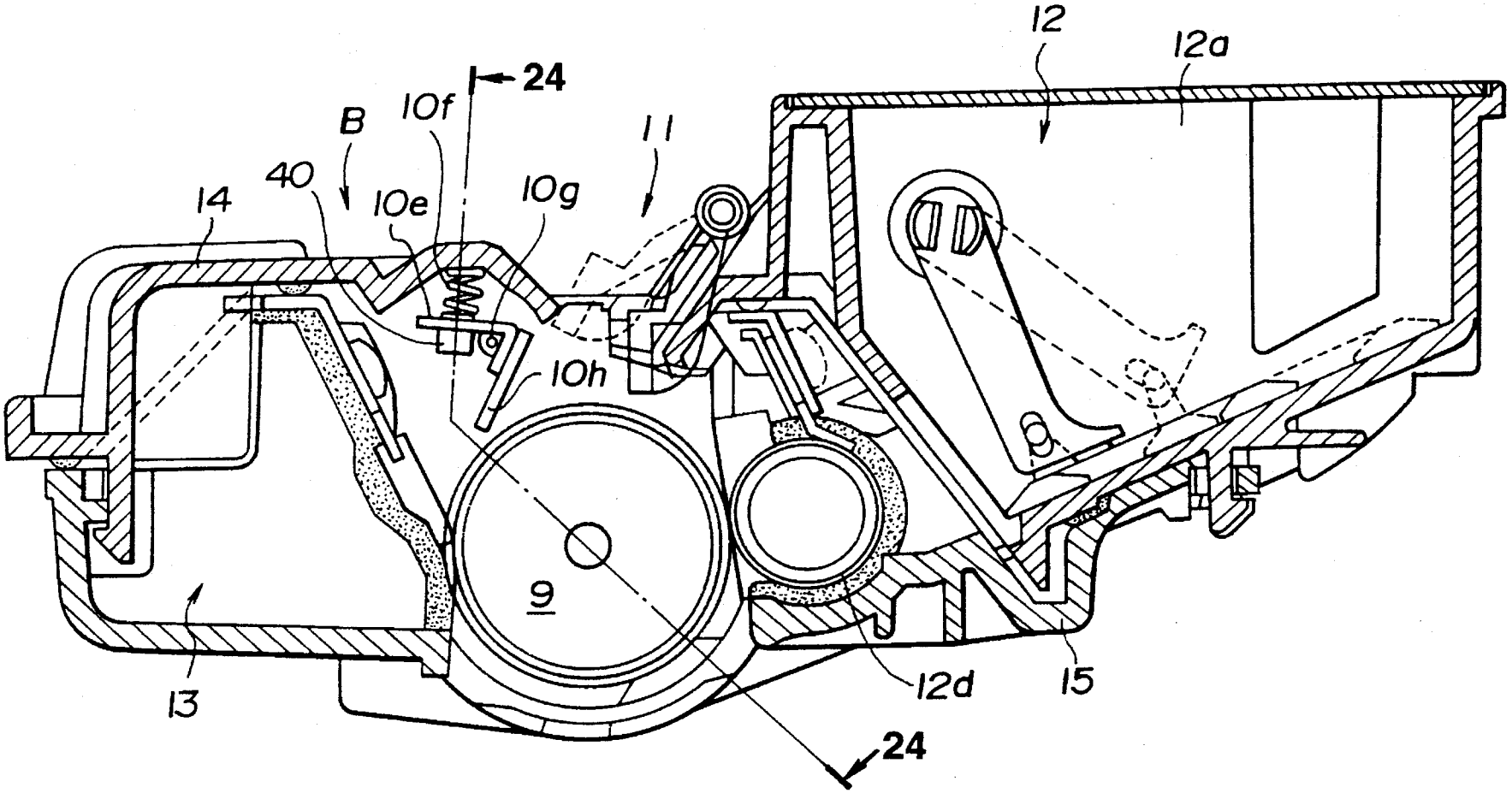
FIG. 23 is a vertical, cross-sectional view of a process cartridge according to a seventh embodiment of the present invention.
Figure 24:
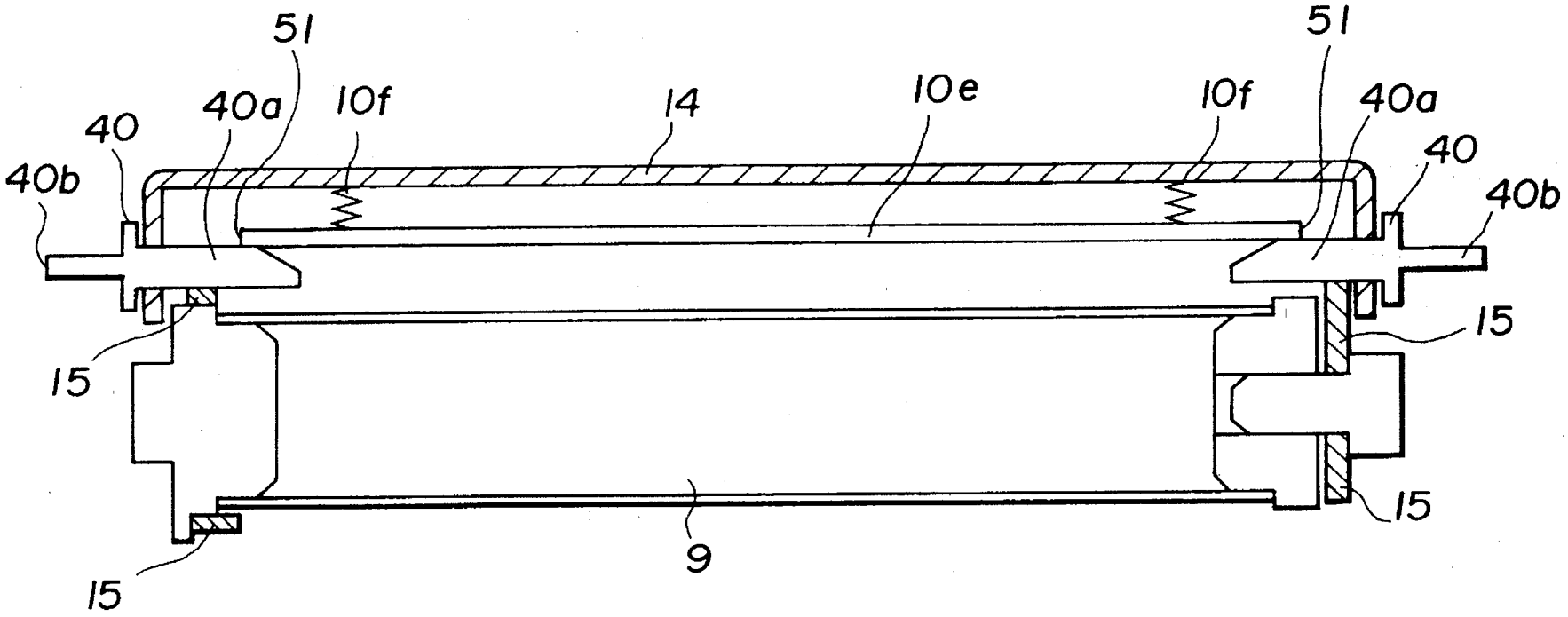
FIG. 24 is a cross-sectional view taken along line 24—24 of the process cartridge shown in FIG. 23.

Next, a description will be provided of a seventh embodiment of the present invention with reference to FIGS. 23 and 24. In FIGS. 23 and 24, components having the same functions as in the sixth embodiment will be indicated by the same reference characters, and a description thereof will be omitted.

While charging roller 10 is provided as charging means in the sixth embodiment, charging blade 10*h* is provided in the present embodiment. Charging blade 10*h* is fixed to blade holder 10*e* rotatably pivoted on upper frame 14 around shaft 10*g*. Blade holder 10*e* is rotated around shaft 10*g* in a counterclockwise direction by springs 10*f*, whereby blade 10*h* is driven toward photosensitive drum 9. FIG. 24 is a cross-sectional view taken along line 24—24 shown in FIG. 23. In the present embodiment, pressure-releasing pieces 40 for separating charging blade 10*h* from photosensitive drum 9 are supported on upper and lower frames 14 and 15 in the vicinity of two ends 51 of blade holder 10*e* in the longitudinal direction. Blade holder 10*e* is raised by distal-end portions 40*a* of the pieces, whereby charging blade 10*h* does not contact photosensitive drum 9.

As in the sixth embodiment, in the present embodiment, in a state in which pressure-releasing pieces 40 for charging roller 10 are mounted in process cartridge B, process cartridge B cannot be mounted in the main body A of the image forming apparatus.

In the above-described embodiments, the description that cartridge B cannot be mounted in the main body A of the image forming apparatus in a state in which the pressure contact state between the image bearing member and the charging member is released indicates that cartridge B cannot be mounted at a predetermined position (a position where an image forming operation can be performed) of the main body A of the image forming apparatus.

In the present invention, by providing pressure-releasing means so that charging means in pressure contact with an image bearing member is separated from the image bearing member when a process cartridge is not used, it is possible to prevent traces by pressure, creep, contamination, and the like from being produced in the image bearing member and the charging means, and thereby to prevent problems in the obtained image. If such pressure release is performed until a process cartridge is used after it has been manufactured, or when a process cartridge for a certain color is replaced by a process cartridge for another color, or until a process cartridge is recycled after it has been used, the above-described effects can be obtained, and the image bearing member and the charging means can be used as they are.

In the present invention, by arranging the process cartridge in the above-described pressure-release state so that it cannot be mounted in the main body of the image forming apparatus, it is possible to prevent problems in the obtained image caused by malfunction of the charging means for the image bearing member.

According to the present invention, an image forming apparatus includes a process cartridge detachable to the main body of the image forming apparatus. The process cartridge includes at least an image bearing member, and contact charging means in pressure contact with the image bearing member disposed therearound. The process cartridge also includes pressure-releasing means capable of contacting/separating the charging means relative to the image bearing member, and pressure-release operation means operating so that the charging means can contact and separate from the image bearing member linked with the pressure-releasing means when mounting and detaching the process cartridge relative to the main body of the image forming apparatus. Thus, when the process cartridge is mounted in the image forming apparatus, the contact charging means is in pressure contact with the image bearing member, and when the process cartridge is detached from the image forming apparatus, the contact charging means is separated from the image bearing member. Accordingly, no particular attention is needed when mounting and detaching the process cartridge relative to the image forming apparatus.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process cartridge detachably mountable in an image forming apparatus, said process cartridge comprising:

an image bearing member for bearing an image; and a charging member, which is movable to be in releasable pressure contact with said image bearing member, for charging said image bearing member, wherein mounting of said process cartridge to the image forming apparatus is prohibited when pressure contact between said image bearing member and said charging member is released.

2. A process cartridge according to claim 1, wherein mounting of said process cartridge in the image forming apparatus is permitted only when said charging member is in pressure contact with said image bearing member.

3. A process cartridge according to claim 1, wherein pressure contact between said image bearing member and said charging member is released when said process cartridge is detached from the image forming apparatus.

4. A process cartridge according to claim 3, further comprising biasing means for separating said image bearing member and said charging member from each other when said process cartridge is detached from the image forming apparatus.

5. A process cartridge according to claim 1, wherein pressure contact between said image bearing member and said charging member is effected when said process catridge is mounted in the image forming apparatus.

6. A process cartridge according to claim 5, wherein pressure contact between said image bearing member and said charging member is released when said process catridge is detached from the image forming apparatus.

7. A process cartridge according to claim 1, wherein said image bearing member and said charging member are separable from each other, and wherein the mounting of said process cartridge in the image forming apparatus is prohibited when said image bearing member and said charging member are separated from each other.

8. A process cartridge according to claim 1, further comprising means for receiving a voltage, supplied from a voltage source provided in the image forming apparatus, to be applied to said charging means.

9. A process cartridge according to claim 1, further comprising developing means for developing said image bearing means with a toner.

10. A process cartridge according to claim 1, further comprising release means for releasing pressure contact between said image bearing member and said charging member.

11. A process cartridge according to claim 10, wherein said release means is removably attached to said process cartridge.

12. An image forming apparatus, comprising:

a process cartridge detachably mountable in said image forming apparatus, said process cartridge comprising an image bearing member for bearing an image, and a charging member, in releasable pressure contact with said image bearing member, for charging said image bearing member; and release means for releasing pressure contact between said image bearing member and said charging member, wherein the mounting of said process cartridge in said image forming apparatus is prohibited when pressure contact between said image bearing member and said charging member is released.

13. An apparatus according to claim 12, wherein said release means is positioned such that said process cartridge is mountable in said image forming apparatus only when said charging member is in pressure contact with said image bearing member.

14. An apparatus according to claim 12, further comprising means for performing a pressure contact operation between said image bearing member and said charging member linked by an operation of said release means, which occurs during an operation of mounting said process cartridge in said image forming apparatus.

15. An apparatus according to claim 12, wherein said release means performs an operation of releasing the pressure contact between said image bearing member and said charging member by an operation of said release means, which occurs during an operation of detaching said process cartridge from said image forming apparatus.

16. An apparatus according to claim 12, further comprising means for performing a pressure contact operation between said image bearing member and said charging member in cooperation with an operation of mounting said process cartridge in said image forming apparatus.

17. An apparatus according to claim 12, wherein said image bearing member and said charging member are separable from each other by an operation of said release means, and wherein the mounting of said process cartridge in said image forming apparatus is prohibited when said image bearing member and said charging member are separated from each other.

18. An apparatus according to claim 12, wherein said release means is provided in said process cartridge.

19. An apparatus according to claim 12, further comprising means for applying a voltage to said charging means when said process cartridge has been mounted in said apparatus.

20. An apparatus according to claim 12, wherein said process cartridge further comprises developing means for developing said image bearing means with a toner.

* * * * *

UNITED STATES PATENT AND TRADEMARK OFFICE

CERTIFICATE OF CORRECTION

PATENT NO. : 5,465,136

DATED : November 7, 1995

INVENTOR(S) : Kazushi WATANABE

It is certified that error appears in the above-indentified patent and that said Letters Patent is hereby corrected as shown below:

COLUMN 3:

Line 2, "10" should be deleted.

COLUMN 5:

Line 54, "Pressure-releasing" should read --pressure-releasing--.

COLUMN 7:

Line 44, "18. In FIGS. 18 and 18," should read --16. In FIGS. 15 AND 16,--.

Signed and Sealed this

Twentieth Day of February, 1996

*Attest:*

*Attesting Officer*

Bruce Lehman

BRUCE LEHMAN

*Commissioner of Patents and Trademarks*